US007731637B2

(12) United States Patent
D'Eredita

(10) Patent No.: US 7,731,637 B2
(45) Date of Patent: Jun. 8, 2010

(54) SIMULATED ROWING MACHINE

(76) Inventor: Michael D'Eredita, 709 Hickory St., Liverpool, NY (US) 13088

( * ) Notice: Subject to any disclaimer, the term of this patent is extended or adjusted under 35 U.S.C. 154(b) by 0 days.

(21) Appl. No.: 12/118,133

(22) Filed: May 9, 2008

(65) Prior Publication Data

US 2008/0280736 A1 Nov. 13, 2008

Related U.S. Application Data

(60) Provisional application No. 60/917,367, filed on May 11, 2007.

(51) Int. Cl.
*A63B 69/06* (2006.01)

(52) U.S. Cl. ..... 482/72; 482/92; 482/138

(58) Field of Classification Search ..... 482/72
See application file for complete search history.

(56) References Cited

U.S. PATENT DOCUMENTS

| | | | | | |
|---|---|---|---|---|---|
| 199,432 | A | | 1/1878 | Goldie | |
| 368,111 | A | | 8/1887 | Reach | |
| 413,015 | A | | 10/1889 | Bigger | |
| 631,531 | A | | 8/1899 | Sargent | |
| 641,596 | A | * | 1/1900 | Kerns | 482/72 |
| 1,111,269 | A | * | 9/1914 | Medart | 482/72 |
| 1,504,375 | A | * | 8/1924 | Phillips | 482/73 |
| 1,577,809 | A | * | 3/1926 | Randall | 482/72 |
| 1,707,791 | A | * | 4/1929 | Anderson | 482/72 |
| 1,905,092 | A | * | 4/1933 | Hardy | 482/72 |
| 1,979,716 | A | | 11/1934 | Terry | |
| 1,980,036 | A | * | 11/1934 | Casler et al. | 482/72 |
| 1,982,843 | A | * | 12/1934 | Traver | 482/70 |
| 2,725,231 | A | | 11/1955 | Hoover | |
| 3,265,362 | A | | 8/1966 | Moody | |
| 3,266,801 | A | * | 8/1966 | Johnson | 482/73 |
| 3,473,843 | A | * | 10/1969 | Hart | 297/130 |
| 3,528,653 | A | * | 9/1970 | Ross et al. | 482/72 |
| 3,589,720 | A | * | 6/1971 | Agamian | 482/114 |
| 3,898,950 | A | * | 8/1975 | Martin | 440/105 |
| 3,912,264 | A | * | 10/1975 | Busse et al. | 482/72 |
| 3,940,989 | A | | 3/1976 | Engerstam | |
| 3,964,742 | A | | 6/1976 | Carnielli | |
| 4,047,715 | A | | 9/1977 | Gjessing | |
| 4,082,267 | A | * | 4/1978 | Flavell | 482/6 |
| 4,084,810 | A | | 4/1978 | Forsman | |
| 4,284,272 | A | * | 8/1981 | Evans et al. | 482/72 |
| 4,346,886 | A | * | 8/1982 | Cox et al. | 482/72 |
| 4,396,188 | A | | 8/1983 | Dreissigacker et al. | |
| 4,452,445 | A | | 6/1984 | Csekes | |
| D277,304 | S | * | 1/1985 | Smith et al. | D21/674 |

(Continued)

FOREIGN PATENT DOCUMENTS

| | | |
|---|---|---|
| CA | 1183559 | 3/1985 |

(Continued)

*Primary Examiner*—Steve R Crow
*Assistant Examiner*—Robert F Long
(74) *Attorney, Agent, or Firm*—George R. McGuire; Frederick J. Price; Bond Schoeneck & King, PLLC

(57) ABSTRACT

The present invention relates generally to rowing machines, and, more particularly, to such rowing machines with internal environments that duplicate actual Olympic-class rowing shells in terms of both dimensions and appearance, and simulate the specific rowing motion and technique that occurs on the water.

44 Claims, 19 Drawing Sheets

U.S. PATENT DOCUMENTS 4,563,000 A * 1/1986 Gall ..... 482/72
D287,389 S * 12/1986 Nadeau ..... D21/674
4,632,386 A 12/1986 Beech
4,649,853 A 3/1987 Powell
4,650,181 A 3/1987 Yang
4,674,741 A * 6/1987 Pasierb et al. ..... 482/72
4,678,184 A 7/1987 Neiger et al.
4,684,126 A * 8/1987 Dalebout et al. ..... 482/138
4,695,050 A * 9/1987 Smith et al. ..... 482/73
4,705,267 A * 11/1987 Jackson ..... 482/138
4,705,269 A 11/1987 DeBoer et al.
4,718,665 A 1/1988 Airy et al.
4,735,410 A * 4/1988 Nobuta ..... 482/9
4,743,010 A * 5/1988 Geraci ..... 482/72
4,743,011 A * 5/1988 Coffey ..... 482/73
4,750,736 A * 6/1988 Watterson ..... 482/73
4,765,615 A 8/1988 Case
D297,853 S * 9/1988 Ostrom ..... D21/674
4,772,013 A 9/1988 Tarlow, Jr.
4,776,587 A 10/1988 Carlson et al.
4,789,153 A 12/1988 Brown
4,867,719 A * 9/1989 duPont ..... 440/101
4,875,674 A * 10/1989 Dreissigacker et al. ..... 482/9
4,889,509 A * 12/1989 Pohlus ..... 440/105
D306,750 S * 3/1990 Kiiski ..... D21/674
4,940,227 A * 7/1990 Coffey ..... 482/73
4,974,832 A * 12/1990 Dalebout ..... 482/72
4,984,986 A * 1/1991 Vohnout ..... 434/247
4,997,181 A * 3/1991 Lo ..... 482/73
5,092,581 A 3/1992 Koz
5,104,363 A * 4/1992 Shi ..... 482/73
D337,799 S * 7/1993 Cutter et al. ..... D21/674
5,295,931 A * 3/1994 Dreibelbis et al. ..... 482/72
5,342,266 A * 8/1994 Dailey ..... 482/71
D352,534 S 11/1994 Dreibelbis et al.
5,364,327 A 11/1994 Graham
D354,099 S * 1/1995 Gerschefske et al. ..... D21/668
5,387,169 A * 2/1995 Wang ..... 482/73
D357,041 S * 4/1995 McBride et al. ..... D21/676
5,407,409 A * 4/1995 Tang ..... 482/70
D358,624 S * 5/1995 Wang et al. ..... D21/673
5,441,469 A * 8/1995 Chern ..... 482/72
D362,283 S * 9/1995 Lee ..... D21/674
5,478,296 A * 12/1995 Lee ..... 482/73
D367,508 S 2/1996 Dreissigacker et al.
5,505,679 A * 4/1996 McBride et al. ..... 482/53
5,554,086 A * 9/1996 Habing et al. ..... 482/137
D375,767 S * 11/1996 Camfield et al. ..... D21/668
5,575,740 A * 11/1996 Piaget et al. ..... 482/70
5,580,340 A * 12/1996 Yu ..... 482/96
D378,110 S * 2/1997 Collinsworth ..... D21/690
5,611,758 A * 3/1997 Rodgers, Jr. ..... 482/57
5,624,357 A 4/1997 Englehart et al.
5,645,514 A * 7/1997 Chen ..... 482/72
5,707,322 A 1/1998 Dreissigacker et al.
D390,289 S * 2/1998 Chen ..... D21/668
5,722,921 A * 3/1998 Simonson ..... 482/100
5,779,600 A * 7/1998 Pape ..... 482/72
5,792,079 A * 8/1998 Hatfield ..... 601/49
5,795,270 A * 8/1998 Woods et al. ..... 482/72
D397,745 S * 9/1998 Wu ..... D21/668
5,820,528 A * 10/1998 McAndrew ..... 482/72
5,916,069 A * 6/1999 Wang et al. ..... 482/72
D414,519 S * 9/1999 Wang et al. ..... D21/676
D425,585 S * 5/2000 Wu ..... D21/676
6,071,215 A * 6/2000 Raffo et al. ..... 482/57
6,093,135 A * 7/2000 Huang ..... 482/72
6,135,930 A * 10/2000 Kuo ..... 482/72
6,196,954 B1 * 3/2001 Chen ..... 482/131
6,224,519 B1 * 5/2001 Doolittle ..... 482/98
6,231,485 B1 5/2001 Dreissigacker et al.
6,328,677 B1 12/2001 Drapeau
6,361,479 B1 * 3/2002 Hildebrandt et al. ..... 482/72
6,371,892 B1 4/2002 Dreissigacker et al.
6,371,895 B1 * 4/2002 Endelman et al. ..... 482/135
6,527,676 B1 3/2003 Frick et al.
6,540,650 B1 * 4/2003 Krull ..... 482/107
6,561,955 B1 5/2003 Dreissigacker et al.
6,565,495 B2 * 5/2003 Slattery ..... 482/142
6,602,168 B2 * 8/2003 Duke ..... 482/72
6,692,410 B1 * 2/2004 Lai ..... 482/52
6,817,968 B2 * 11/2004 Galbraith et al. ..... 482/72
6,939,186 B1 * 9/2005 Kuckes ..... 440/104
6,981,932 B1 * 1/2006 Huang et al. ..... 482/72
7,022,052 B1 * 4/2006 Lai ..... 482/72
7,112,165 B1 9/2006 Forsberg
7,201,708 B2 4/2007 Dreissigacker et al.
7,207,853 B2 * 4/2007 Spencert et al. ..... 440/21
7,226,397 B1 * 6/2007 MacDonald et al. ..... 482/72
7,232,404 B2 * 6/2007 Nelson ..... 482/140
7,252,627 B2 * 8/2007 Carter ..... 482/98
7,413,532 B1 * 8/2008 Monsrud et al. ..... 482/99
7,455,633 B2 * 11/2008 Brown et al. ..... 482/142
D584,367 S * 1/2009 Augustine et al. ..... D21/662
7,572,211 B2 * 8/2009 Roach ..... 482/72
2002/0151415 A1 * 10/2002 Hildebrandt et al. ..... 482/57
2003/0045406 A1 * 3/2003 Stone ..... 482/100
2003/0166438 A1 9/2003 Gramaccioni
2004/0009849 A1 * 1/2004 Galbraith et al. ..... 482/72
2005/0032611 A1 * 2/2005 Webber et al. ..... 482/72
2005/0130810 A1 * 6/2005 Sands ..... 482/72
2005/0148444 A1 7/2005 Thomas
2005/0170711 A1 * 8/2005 Spencer et al. ..... 440/21
2005/0277521 A1 * 12/2005 Lat ..... 482/72
2006/0166798 A1 * 7/2006 Nelson ..... 482/140
2007/0082793 A1 * 4/2007 Yang ..... 482/72
2007/0149370 A1 * 6/2007 Brown et al. ..... 482/140
2007/0191192 A1 * 8/2007 Alessandri et al. ..... 482/72
2007/0197347 A1 * 8/2007 Roach ..... 482/72
2008/0070765 A1 * 3/2008 Brown et al. ..... 482/140
2008/0070766 A1 * 3/2008 Brown et al. ..... 482/140
2008/0125291 A1 * 5/2008 Watt et al. ..... 482/52
2009/0018000 A1 * 1/2009 Brown et al. ..... 482/140

FOREIGN PATENT DOCUMENTS

| | | |
|---|---|---|
| DE | 3404562 | 8/1985 |
| EP | 0214748 | 3/1987 |
| FR | 474721 | 12/1913 |
| GB | 347533 | 4/1931 |
| GB | 2175813 | 12/1986 |
| SU | 1248615 | 8/1986 |
| WO | WO8701953 | 4/1987 |

* cited by examiner

SIMULATED ROWING MACHINE

RELATED APPLICATION

The present application claims priority to U.S. provisional patent application No. 60/917,367, filed on May 11, 2007; all of the foregoing patent-related document(s) are hereby incorporated by reference herein in their respective entirety(ies).

BACKGROUND OF THE INVENTION

1. Field of Invention

The present invention relates generally to rowing machines, and, more particularly, to such rowing machines with internal environments that duplicate actual Olympic-class rowing shells in terms of both dimensions and appearance, and simulate the specific rowing motion and technique that occurs on the water.

2. Description of Prior Art

The three most influential rowing machines over the past 40, or so, years were the "Gamut Erg" ("Gamut") (no longer produced), "Gjessing Erg" ("Gjessing") (no longer produced) and Concept 2 rowing machine. Numerous replicas of the Concept 2 exist, for example, the Waterrower line of rowing machines and the Tunturi line of rowing machines. Additional machines that have come on the market include the Rowperfect and the Coffey Sculling Machine (no longer produced) (as should be appreciated by those skilled in the art).

While some Gamut's are still in use, they are no longer in production. The Gamut is composed of heavy steel and is designed to simulate the sweeping action of an Olympic-class rowing shell. A steel flywheel dampened by an adjustable friction mechanism is used as a resistance mechanism. While the Gjessing was used more in Europe, it also is no longer in production. The Gjessing required the user to push and pull a handle connected to a long shaft, the end of which was attached to a cable. The cable wound around a winch of variable diameters that drove a flywheel arranged in a similar manner to that of the Gamut. The Gjessing improved upon the design of the Gamut by allowing the user to experience different degrees of leverage on the flywheel as the stroke progressed. This gave the user the feeling of acceleration experienced in the rowing shell. Unlike the Gamut which allowed the user to experience the arcing sweep motion of the oar handle, the Gjessing required the user to push and pull on a handle that moved fore and aft in a linear manner which allowed for a design that reduced the space requirements of the machine.

The Concept 2 Rower is the current "standard" within the rowing community. It improves upon the Gamut and Gjessing in that it offers users a more affordable, space-efficient and lightweight design. Like the Gjessing, the Concept 2 Rower requires the user to pull on a handle that moves fore and aft in one plane, however, the handle is directly connected to a flywheel via a chain and clutching sprocket mechanism. The flywheel is similar to that of a blower-wheel, the resistance of which is adjusted by varying the amount of air allowed to flow through the blower wheel. This allows for some acceleration to be felt as with the Gjessing, however, the flywheel configuration is much lighter and requires much less space.

All three of these machines, as well as all others mentioned above, incorporate a measurement system specific to each machine. While none of the machines have the capability to interconnect their resistance mechanism (though, the Rowperfect does allow flywheels of machines side-by-side to be directly connected), the Concept 2 Rower is able to be configured in a line such that each machine is required to move in unison with the rest via "slides." Similar to the Rowperfect, this configuration tends to keep the center of gravity of each rower stationary as the components of the machine slide fore and aft under the user. The resistance mechanism of each rower, however, remains independent.

All of the above machines have strengths that range from more realistic rowing environments (Gamut and Coffey), to more realistic feeling resistance mechanisms (Gjessing), to connectivity (Concept 2 and Rowperfect), to space-efficiency (Concept 2 and Rowperfect) to more affordable design (Concept 2). However, none of the machines combine this functionality into one "package."

SUMMARY OF THE INVENTION

It would be useful and desirable for a rowing machine to blend a number of factors mentioned above while adding new functionality to produce an "on-land" simulated rowing environment. In particular, it would be useful and desirable for a rowing machine to have an internal environment that duplicates an actual Olympic-class rowing shell in terms of both dimensions and appearance, and that simulates the specific rowing motion and technique that occurs on the water. It would also be useful and desirable for a rowing machine to be able to be attached to other rowing machines, and at the same time, be coupled to the attached rowing machines' resistance mechanisms. In addition, it would be useful and desirable for such a rowing machine to be able to translate common measurements taken from a rowing machine to an actual rowing shell on the water, and vice versa, with a relatively small amount of extrapolation.

In accordance with an embodiment of the present invention, rowing machines, and, more particularly, rowing machines with internal environments that duplicate actual Olympic-class rowing shells in terms of both dimensions and appearance, and simulate the specific rowing motion and technique that occurs on the water, are provided. A rowing machine of an embodiment of the present invention is operable to simulate the rowing environment of an actual rowing shell in terms of individual psychological (cognition and learning), social psychological (social cognition and team/group learning) and physiological (fitness) factors.

In accordance with an embodiment of the present invention, a rowing machine that enables users to experience a fully simulated environment that can be "rigged" in the same manner as a rowing shell (e.g., adjustments to "outboard," "inboard," "spread," "through pin," "height" can be made), is provided.

In accordance with an embodiment of the present invention, a rowing machine that allows multiple users to join machines together in a manner that simulates the team-boat environment (e.g., a 2× configuration that has similar dimensions to a 2×) while connecting resistance mechanism assemblies directly to each other, is provided. This connectivity allows for both drive and recovery motions to be coupled in a manner in which the users are in a position to drive their "teammates" resistance mechanism assemblies and visa-versa.

In accordance with an embodiment of the present invention, a rowing machine that allows the user to use the same measuring devices on the rowing machine as they would in the boat due to the simulated environment, as noted supra, is provided.

In accordance with an embodiment of the present invention, a rowing machine that has a minimalist design relative to its functionality that requires a similar amount of space as, for example, the Concept 2 Rower, yet less space when in a team-boat configuration compared to similar configurations of other machines, is provided.

In accordance with an embodiment of the present invention, a rowing machine that allows for side-to-side motion as one would experience in a rowing shell with a configuration that allows gyroscopic forces that change with speed to be felt by the user, is provided.

In accordance with an embodiment of the present invention, a rowing machine of an embodiment of the present invention comprises a sled-rigger assembly, drive cable assembly, and a shell-base assembly.

In accordance with an embodiment of the present invention, the sled-rigger assembly of an embodiment of the present invention comprises a rigger assembly and a sled assembly. The rigger assembly comprises a rigger and rigger mounts, an oar assembly, and a backstay. For a sculling configuration comprising 2 oars, etc. (an alternative embodiment of the present invention contemplates a sweep configuration which comprises 1 oar, etc.), the oar assembly comprises two: pins, oarlocks, pin mounting slots, oar shafts, adjustable oar handles, oar sleeves, and oar clamps. The sled assembly comprises a sled, resistance mechanism assembly (an alternative embodiment contemplates a parallel axle configuration), resistance mechanism mount, seat, seat tracks, sled bearings (an alternative embodiment of the present invention contemplates captivating wheels), and shoe plates, and shoes. The resistance mechanism assembly comprises at least one drive winch, carrier winch, a ring gear, planetary gear, sun gear, drive winch-to-carrier winch clutch, carrier mounting and planetary axle screw, drive shaft, drive winch mounting bearing, planetary assembly mounting bearing, carrier plate, weight component of resistance mechanism, dampening component of resistance mechanism, clutching flywheel mounting bearing, and flywheel retaining clamp.

In accordance with an embodiment of the present invention, the drive cable assembly (an alternative embodiment of the present invention contemplates a belt and/or chain assembly) of an embodiment of the present invention comprises a drive cable system comprising a drive cable and a recovery cable, and a sled-drive cable system comprising a sled-drive cable and a sled-recovery cable. The drive cable system and the sled-drive cable system can each comprise a single cable (or belt or chains, etc.) or can comprise of a plurality of cables (or belts or chains, etc.). The drive cable assembly further comprises an oar-to-cable mount, drive cable length adjuster, recovery cable flexor, drive cable rigger guide pulley mount, drive cable rigger guide pulley, front (stem) recovery cable guide, internal recovery cable guide, rear (bow) drive cable guide, internal drive cable guide, rear (bow) sled-recovery adjustable cable mounts, front (stern) sled drive adjustable cable mount, and front (stern) sled drive cable flexor.

In accordance with an embodiment of the present invention, the shell-base assembly of an embodiment of the present invention comprises a shell, base, adjustable base feet, shell-sled interface shaft (an alternative embodiment of the present invention contemplates v-groove bearings and platform for wheel configuration, or any mechanism that allows rotation along the longitudinal axis of shell while allowing captivation of the shell), shell-sled interface shaft inner mounts, shell-sled interface shaft end mounts, double shell ribs, retaining slots, wheel-shell captivator and dampener, and base-shell interface rollers.

In accordance with an embodiment of the present invention, a rowing machine is provided which is operable to allow for the simulation or duplication of any manufacturer's rowing shell cock-pit design. A rowing machine of an embodiment of the present invention allows a rower to "get it" from the moment the rower puts their feet in the shoes on the shoe plates and puts their hands on the adjustable oar handle(s). They feel the pressure on the oarlocks and the load on the oars as they begin to pull. They feel the glide and rhythm as they "release pressure" at the finish and move to the catch for their next stroke. The resistance mechanism assembly offers the feeling of movement beneath them as they feel its momentum. The resistance mechanism assembly is operable to produce a gyroscopic effect that is felt as the rower finds more stability as the speed of "the hull" increases. All adjustments in regard to "rigging" (or sweep and/or sculling dimensions) on an actual rowing shell on the water (e.g., spread, height, shoes, inboard ratios, outboard ratios etc.) can be adapted to fit most rowing shell designs and "rigged" to meet the needs of any individual rower. These "rigging" numbers can be easily extrapolated and transferred from the rowing machine of an embodiment of the present invention to an actual rowing shell on the water and visa-versa.

In accordance with an embodiment of the present invention, the rowing machine of an embodiment of the present invention is designed as both a stand-alone machine or as a component that can be combined with other rowing machines in any rowing configuration desired, (e.g., 1×, 1+, 2×, 4×, 2−, 4−, 8+, etc.), as will be appreciated by those skilled in the art. The rowing machine of an embodiment of the present invention allows for the resistance mechanism assemblies of the rowing machines to be directly connected to each other by virtue of connecting rowing machines of an embodiment of the present invention together. This coupling together of individual rowing machines of an embodiment of the present invention provides a component-based training system that allows for the attachment of resistance mechanism assemblies. This is achieved through the design and configuration of the resistance mechanism assembly and its coupling to both the oars and the sled of the rowing machine of an embodiment of the present invention.

This coupling of resistance mechanism assemblies requires the users of the machines to work together to spin the resistance mechanism assemblies of the plurality of sets of rowing machines. If a rower is not pulling or not moving with the common rhythm (e.g., not pulling together as a team, one rower not pulling at all, different power application by the individual rowers, etc.), the entire row team will feel it in the same manner they feel it in an actual boat on the water and performance of both individuals and the team will diminish. The mounting of the resistance mechanism in the rowing machine of an embodiment of the present invention allows for this "realistic" feeling, which is neither contrived nor pretend.

In accordance with an embodiment of the present invention, each individual rower's performance will be enhanced if the team is similarly applying power while using their respective rowing machines of an embodiment of the present invention. Most importantly, as noted supra, each team member will feel the power and movements of other team members while using the rowing machine of an embodiment of the present invention, as they would in an actual rowing shell on the water.

In accordance with an embodiment of the present invention, a rowing machine comprising a sled and a shell is provided that is operable to glide and rotate, offering the experience of "floating" on water to the user. The combined dimensions of side-to-side, rotational motion of the shell, and the front-and-back gliding motion of the sled allows for the feeling of gliding and floating in a rowing shell. Additionally, the side-to-side action can be dampened by the user to allow for a more stable environment.

In accordance with an embodiment of the present invention, a rowing machine is provided which affords the ability to use the same metrics on and off the water—with minimal extrapolation required. The rowing machines of an embodiment of the present invention are operable to allow users to "rig" the machine to take measurements and integrate the results from these measurements into the machine, in terms of geometry of motion that a user's body and limbs are making, and the like (measurements and results taken from a boat on the water can be transferred to the rowing machine of an embodiment of the present invention and vice versa). In particular, the rowing machines of an embodiment of the present invention are operable to allow one to measure and compare, for example, strokes per minute, speed, power, power-curves, force, etc., by simply inserting a specific oarlock or magnet onto the machine. These devices, as should be appreciated by those skilled in the art, are currently being manufactured, for example, by Webasport and Neilsen Kellerman. These devices were originally designed to be used on a boat, but is also a preferred means of measurement for the rowing machines of an embodiment of the present invention. This, in conjunction with the resistance mechanism assembly (as discussed supra and infra), will allow for individual performance on the rowing machines of an embodiment of the present invention to be compared to that of an individual's performance, an individual's performance within a team and/or a team's performance, both on-land in the machine and on-water in an actual rowing shell.

For example, an embodiment of the present invention contemplates testing a team of at least two people on the rowing machine of an embodiment of the present invention and obtaining a number (along with a user perceptible feeling among the team members) that can be directly transferred to an actual rowing shell on the water. This can be done in order for the best team or partners to be chosen for competition in an actual rowing shell on the water and/or for working on a team's technique, etc., after such a team has been chosen.

This aspect of an embodiment of the present invention (translation of a common metric from the rowing machine of an embodiment of the present invention to an actual rowing shell on the water) is also applicable to a single rower situation.

In accordance with an embodiment of the present invention, a rowing machine is provided which comprises a sled-rigger assembly comprising a front end and a rear end defining a longitudinal axis therebetween, wherein the rear end comprises a first rear end cable guide; a first oar assembly, having a first connection portion, constrained to the sled-rigger assembly so that the first oar assembly is at least free to rotate with respect to the sled-rigger assembly; a first drive winch rotatably mounted to the sled-rigger assembly; and a first drive cable assembly comprising a first drive cable having a first connection portion, the first connection portion of the first drive cable of the first drive cable assembly being mechanically connected to the first connection portion of the first oar assembly, and wherein the first drive cable of the first drive cable assembly is operatively engaged with the first rear end cable guide, is circumferentially connected to the first drive winch, and is adapted to rotate the first drive winch in a first direction.

The front end of the sled-rigger assembly can further comprise a first front end cable guide. The first oar assembly can further comprise a second connection portion.

The first drive cable assembly can further comprise a first recovery cable having a first connection portion, the first connection portion of the first recovery cable of the first drive cable assembly being mechanically connected to the second connection portion of the first oar assembly, and wherein the first recovery cable of the first drive cable assembly is operatively engaged with the first front end cable guide, is circumferentially connected to the first drive winch, and is adapted to rotate the first drive winch in a second direction. The first direction of rotation of the first drive winch can be different from the second direction of rotation of the first drive winch.

The rear end of the sled-rigger assembly can further comprise a second rear end cable guide. The rowing machine can further comprise a second oar assembly, having a first connection portion, constrained to the sled-rigger assembly so that the second oar assembly is at least free to rotate with respect to the sled-rigger assembly. The rowing machine can further comprise a second drive winch rotatably mounted to the sled-rigger assembly, and a second drive cable assembly comprising a first drive cable having a first connection portion, the first connection portion of the first drive cable of the second drive cable assembly being mechanically connected to the first connection portion of the second oar assembly, and wherein the first drive cable of the second drive cable assembly is operatively engaged with the second rear end cable guide, is circumferentially connected to the second drive winch, and is adapted to rotate the second drive winch in a first direction.

The front end of the sled-rigger assembly can further comprise a second front end cable guide. The second oar assembly can further comprise a second connection portion. The second drive cable assembly can further comprise a first recovery cable having a first connection portion, the first connection portion of the first recovery cable of the second drive cable assembly being mechanically connected to the second connection portion of the second oar assembly, and wherein the first recovery cable is operatively engaged with the second front end cable guide, is circumferentially connected to the second drive winch, and is adapted to rotate the second drive winch in a second direction. The first direction of rotation of the second drive winch can be different from the second direction of rotation of the second drive winch.

The rowing machine can further comprise a first clutch rotatably mounted to the sled-rigger assembly and operatively engaged with the first drive winch. The rowing machine can further comprise a first carrier winch rotatably mounted to the sled-rigger assembly, the first carrier winch being adapted to be operatively engaged and disengaged to the first drive winch via the first clutch. The first drive winch can be adapted to drive the first carrier winch in the first direction via the first clutch when the first drive winch is operatively engaged with the carrier winch via the first clutch. The first clutch can be a unidirectional clutch or a bidirectional overrunning clutch. The first carrier winch can be adapted to overrun in the first and the second direction.

The rowing machine can further comprise a first resistance assembly rotatably mounted to the sled-rigger assembly, where the first resistance assembly is operatively engaged to the first carrier winch. The first carrier winch can be adapted to drive the first resistance assembly in the first direction. The first resistance assembly can further comprise a first weight component and a first dampening component. The first resistance assembly can comprise a first flywheel.

The rowing machine can further comprise a shell-base assembly comprising a front end and a rear end, upon which the sled-rigger assembly is constrained so that it can move with respect to the shell-base assembly along the longitudinal axis. The front end of the shell-base assembly can further comprise a first front cable mount. The rowing machine can further comprise a first sled-drive cable assembly comprising a first sled-drive cable having a first connection portion, the first connection portion of the first sled-drive cable of the first sled-drive cable assembly being mechanically connected to the first front cable mount, and wherein the first sled-drive cable of the first sled-drive cable assembly is circumferentially connected to the first carrier winch, and is adapted to move the sled-rigger assembly in a first direction along the longitudinal axis. The rear end of the shell-base assembly can further comprise a first rear cable mount. The first sled-drive cable assembly can further comprise a first sled-recovery cable having a first connection portion, the first connection portion of the first sled-recovery cable of the first sled-drive cable assembly being mechanically connected to the first rear cable mount, and wherein the first sled-recovery cable of the first sled-drive cable assembly is circumferentially connected to the first carrier winch.

The rowing machine can further comprise a recoil mechanism adapted to move the sled-rigger assembly in a second direction along the longitudinal axis. The first direction of movement of the sled-rigger assembly can be different from the second direction of movement of the sled-rigger assembly. The recoil mechanism can further comprise a first recoil spring interconnected to the sled-rigger assembly and to the shell-base assembly.

In accordance with an embodiment of the present invention, a rowing machine is provided which comprises a shell-base assembly comprising a front end and a rear end, wherein the front end of the shell-base assembly further comprises a first front cable mount; a sled member comprising a front end and a rear end defining a longitudinal axis therebetween being constrained to the shell-base assembly so that it can move with respect to the shell-base assembly along the longitudinal axis; a first carrier winch rotatably mounted to the sled member; a first sled-drive cable assembly comprising a first sled-drive cable having a first connection portion, the first connection portion of the first sled-drive cable of the first sled-drive cable assembly being mechanically connected to the first front cable mount, and wherein the first sled-drive cable of the first sled-drive cable assembly is circumferentially connected to the first carrier winch, and is adapted to move the sled member in a first direction along the longitudinal axis.

The rear end of the shell-base assembly can further comprise a first rear cable mount. The first sled-drive cable assembly can further comprise a first sled-recovery cable having a first connection portion, the first connection portion of the first sled-recovery cable of the first sled-drive cable assembly being mechanically connected to the first rear cable mount, and wherein the first sled-recovery cable of the first sled-drive cable assembly is circumferentially connected to the first carrier winch. The rowing machine can further comprise a recoil mechanism adapted to move the sled member in a second direction along the longitudinal axis. The first direction of movement of the sled member can be different from the second direction of movement of the sled member. The recoil mechanism can further comprise a first recoil spring interconnected to the sled member and to the shell.

The rowing machine can further comprise a first drive winch rotatably mounted to the sled member. The rowing machine can further comprise a first clutch rotatably mounted to the sled-member and operatively engaged with the first drive winch. The first carrier winch can be adapted to be operatively engaged and disengaged to the first drive winch via the first clutch. The first drive winch can be adapted to drive the first carrier winch in a first direction via the first clutch when the first drive winch is operatively engaged with the carrier winch via the first clutch. The first clutch can be a unidirectional clutch or a bidirectional overrunning clutch. The first carrier winch can be adapted to overrun in the first direction and in the second direction.

The rowing machine can further comprise a first resistance assembly rotatably mounted to the sled-member, the first resistance assembly is operatively engaged to the first carrier winch. The first carrier winch can be adapted to drive the first resistance assembly in the first direction. The first resistance assembly can further comprise a first weight component and a first dampening component. The first resistance assembly can comprise a first flywheel.

In accordance with an embodiment of the present invention, a rowing machine is provided which comprises a sled member assembly comprising a front end and a rear end defining a longitudinal axis there between being constrained to the shell-base assembly so that it can move with respect to the shell-base assembly along the longitudinal axis and comprising a first connection portion; a shell-base assembly comprising a first pulley; a resistance mechanism assembly mechanically connected to the shell-base assembly comprising: a frame; a winch rotatably mounted to the frame; a drive cable assembly comprising a first drive cable having a first connection portion, the first connection portion of the first drive cable of the drive cable assembly being mechanically connected to the first connection portion, and wherein the first drive cable of the drive cable assembly is operatively engaged with the first pulley, is circumferentially connected to the winch, and is adapted to rotate the first winch in a first direction.

The shell-base assembly can further comprise a second pulley. The sled member assembly can further comprise a second connection portion. The drive cable assembly can further comprise a first recovery cable having a first connection portion, the first connection portion of the first recovery cable of the drive cable assembly being mechanically connected to the second connection portion, and wherein the first recovery cable of drive cable assembly is operatively engaged with the second pulley, is circumferentially connected to the winch, and is adapted to rotate the first winch in a second direction. The resistance mechanism can further comprise a first clutch rotatably mounted to the frame and operatively engaged with the winch. The resistance mechanism can further comprise a resistance component rotatably mounted to the frame, the resistance component being adapted to be operatively engaged and disengaged to the winch via the first clutch. The winch can be adapted to drive the resistance component in the first direction via the first clutch when the winch is operatively engaged with the resistance component via the first clutch. The clutch can be a unidirectional clutch. The resistance mechanism can be selected from the group consisting of a first weight component and a first dampening component. The resistance mechanism can comprise a flywheel.

In accordance with an embodiment of the present invention, a rowing machine is provided which comprises a base member adapted to, in operation of the machine, rest on and remain at least substantially fixed with respect to the ground; a first rotational member constrained to the base member; a shell member comprising an elongated first surface defining a first longitudinal direction, with the shell member being located at least substantially on top of the base member so that the first surface can rotate with respect to the first rotational member along the first longitudinal direction, and with the shell member being constrained so that can move with respect to the base member only along the first longitudinal direction; and a sled member constrained with respect to the shell member so that it can move with respect to the shell member only in a second longitudinal direction. The first rotational member can comprise a first roller member constrained to the base so that it can rotate with respect to the base in a first angular direction.

The first surface can have at least a substantially arcuate shape. The second longitudinal direction can be at least substantially linear. The second longitudinal direction can be at least substantially perpendicular to the first longitudinal direction. The rowing machine can further comprise a user platform shaped to accommodate a user, with the user platform being constrained to the sled member so that the user platform can move with respect to the sled member along a third longitudinal direction. The third longitudinal direction can be at least substantially linear. The third longitudinal direction can be at least substantially identical to the second longitudinal direction. The user platform can be shaped as a seat suitable for accommodating a user in the sitting position. The rowing machine can further comprise a first oar assembly mechanically connected to the sled. The shell member can further comprise a first retaining slot. The base member can further comprise a first wheel-shell captivator and dampener mechanically connected to the first retaining slot.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections and/or magnetic connections.

BRIEF DESCRIPTION OF THE DRAWINGS

The present invention will be more fully understood and appreciated by reading the following Detailed Description in conjunction with the accompanying drawings, in which.

DETAILED DESCRIPTION

Reference will now be made in detail to the present preferred embodiments of the invention, examples of which are illustrated in the accompanying drawings.

In accordance with an embodiment of the present invention, a rowing machine of an embodiment of the present invention comprises a sled-rigger assembly, drive cable assembly, and a shell-base assembly.

Figure 1A:
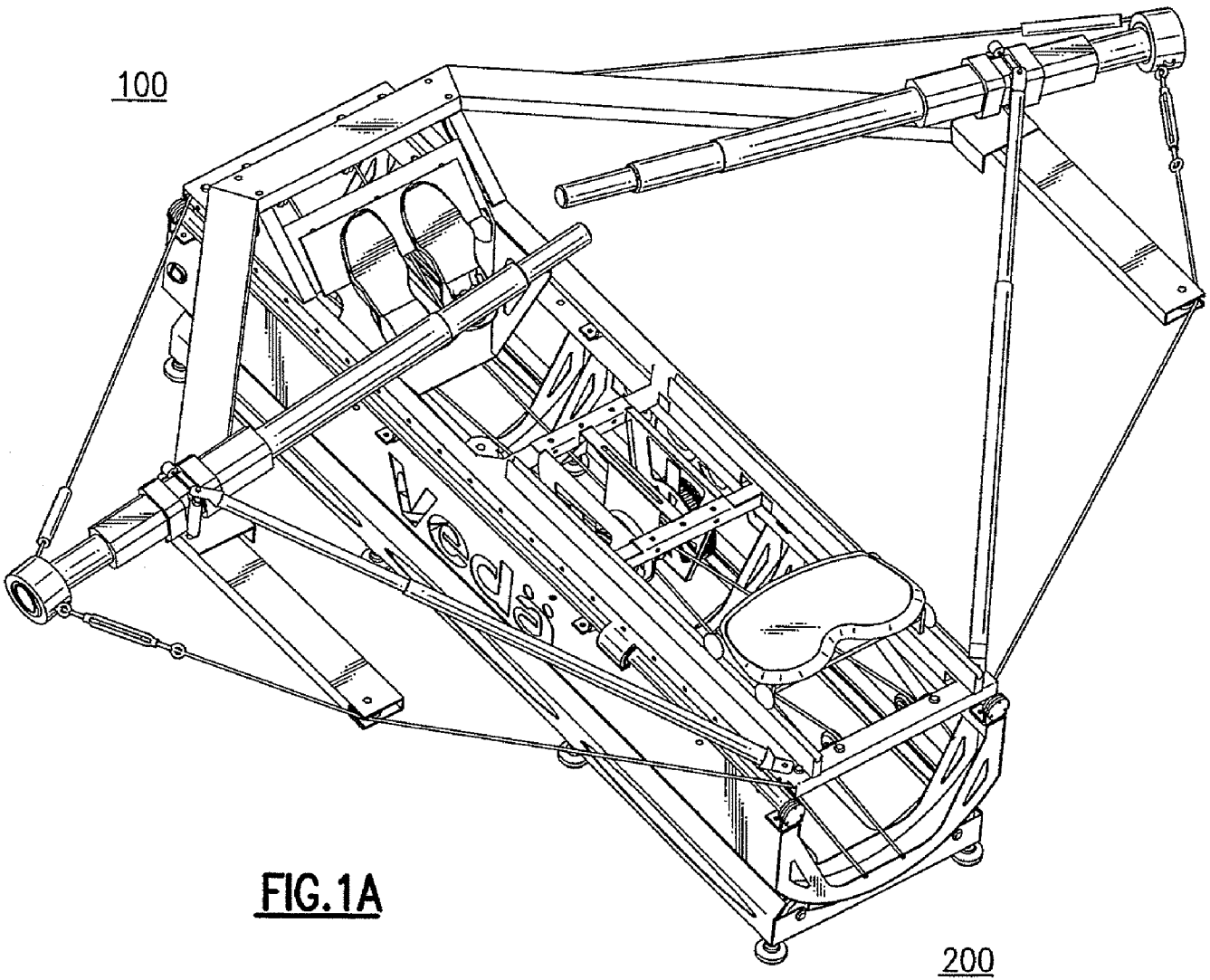
FIGS. 1*a* and 1*b* are top perspective views that illustrate a rowing machine according to an embodiment of the present invention.

Referring to the drawings, wherein like reference numerals refer to like components, FIG. 1*a* shows a top perspective view illustrating a rowing machine comprising a front (stern) 100 and a rear (bow) 200 creating a centerline or longitudinal axis therebetween (not shown), and a sled rigger assembly according to an embodiment of the present invention.

Figure 1B:
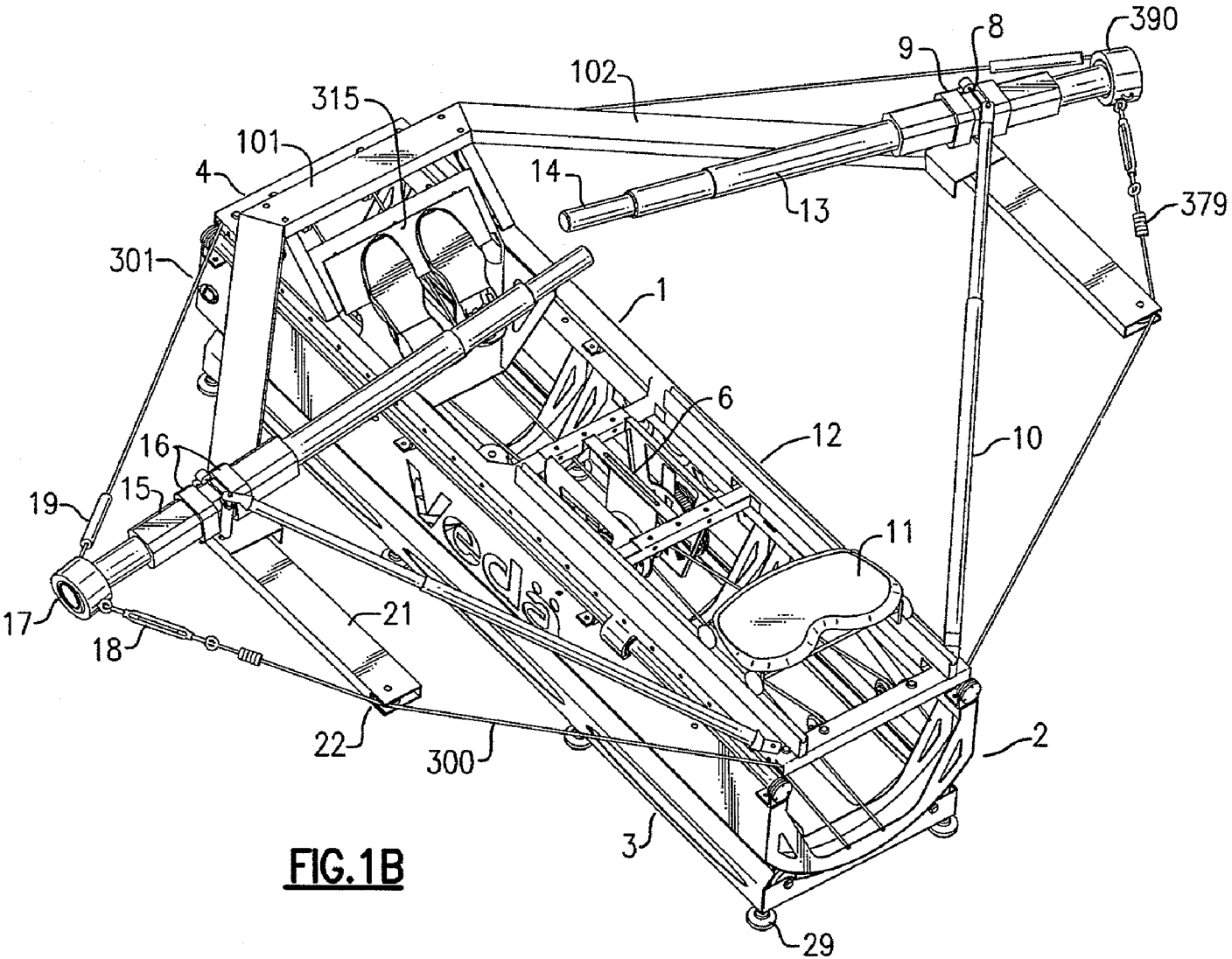
Figure 1C:
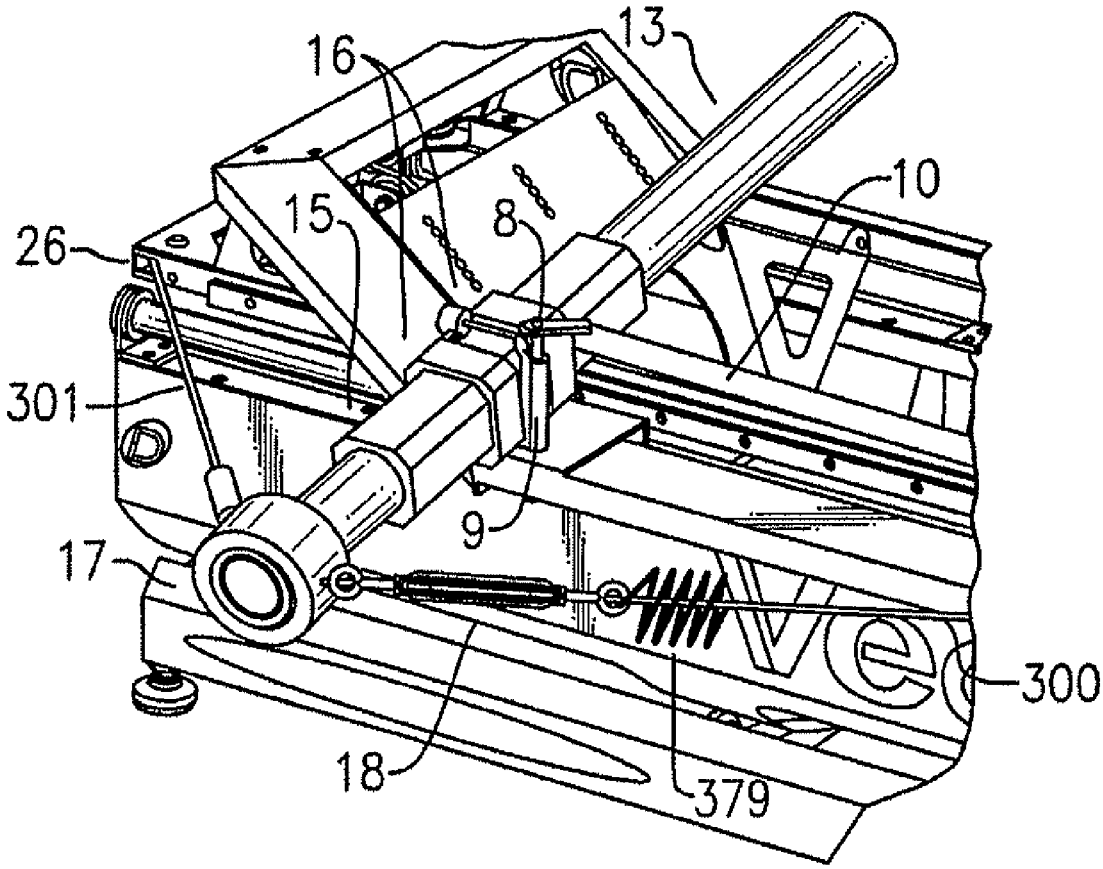
FIG. 1*c* is a side close-up perspective view of parts of a rigger assembly of the rowing machine according to an embodiment of the present invention.
Figure 2:
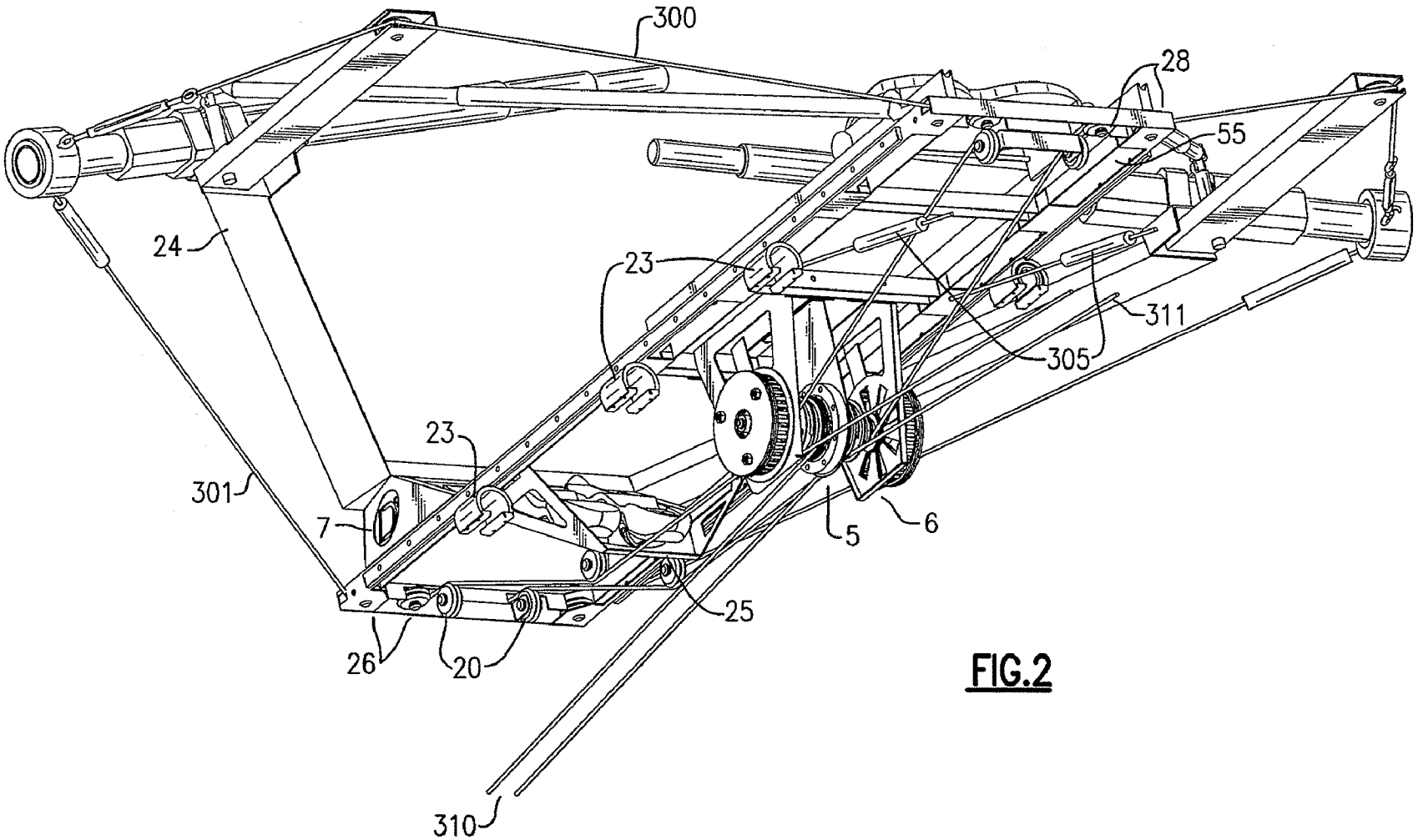
FIG. 2 is a bottom perspective view that illustrates a rowing machine comprising a sled rigger assembly according to an embodiment of the present invention.
Figure 3:
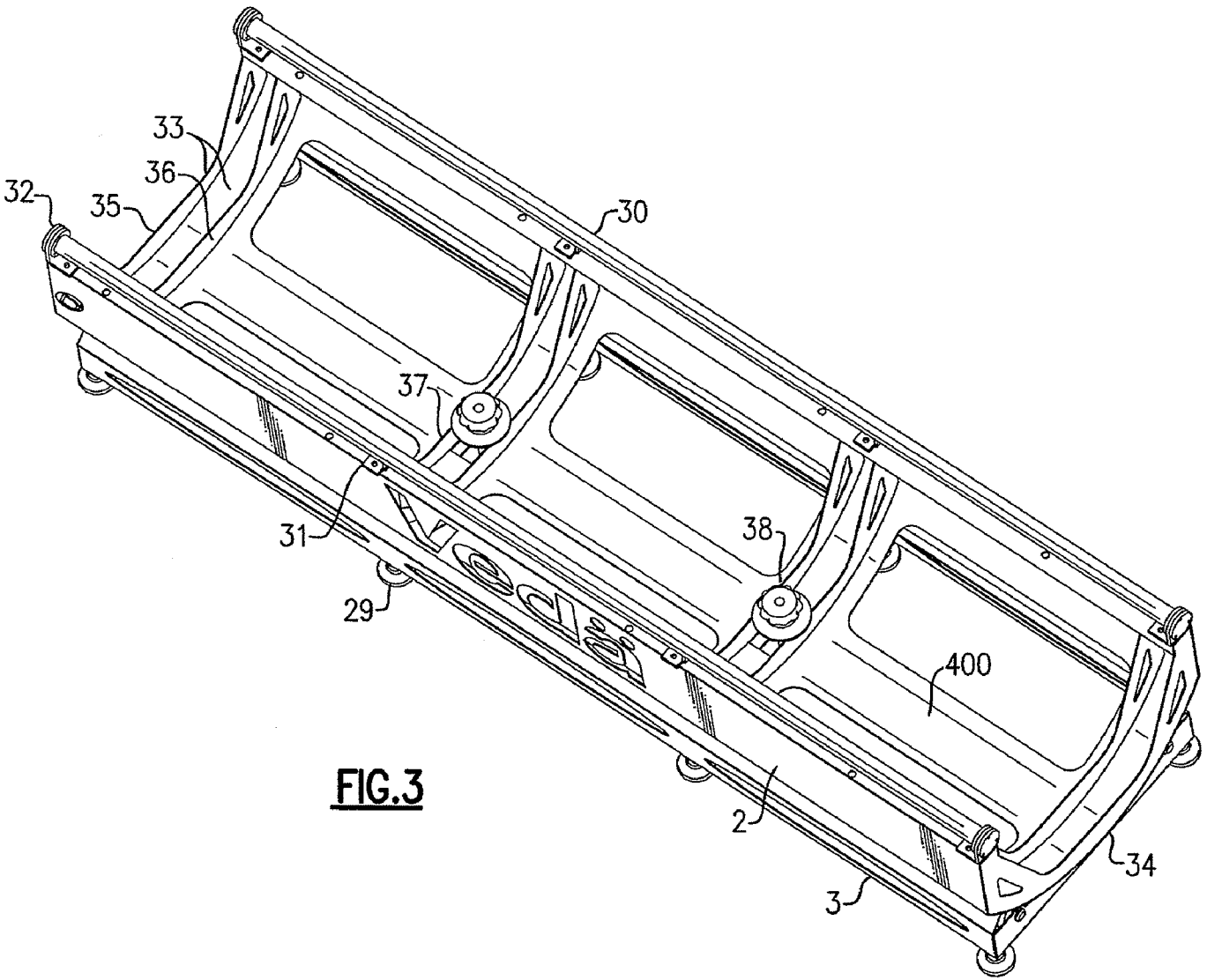
FIG. 3 is a top perspective view that illustrates a shell-base assembly of the rowing machine according to an embodiment of the present invention.
Figure 4:
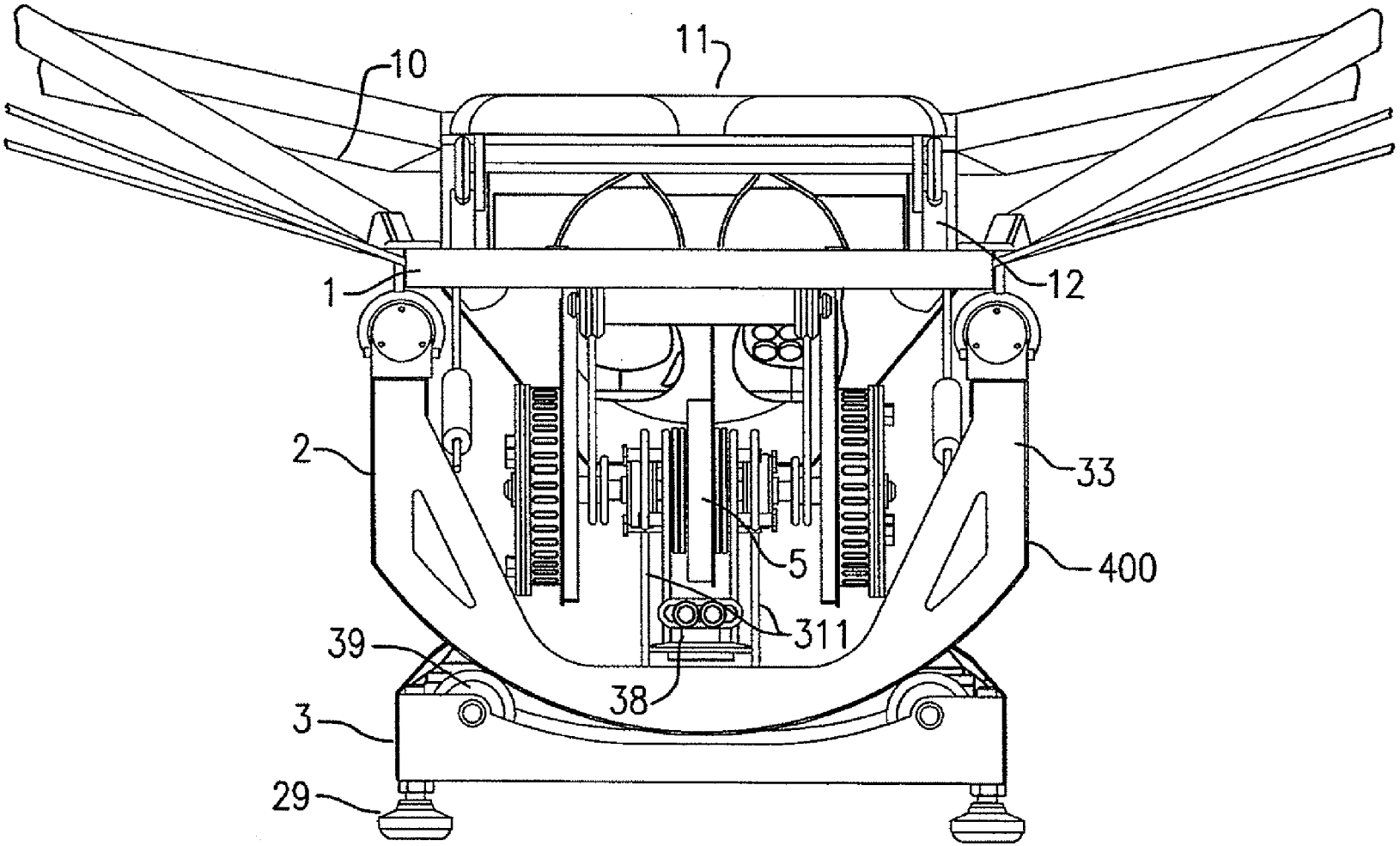
FIG. 4 is a rear perspective view that illustrates a rowing machine according to an embodiment of the present invention.

FIGS. 1*b*, 1*c*, and 2 show various views that illustrate a rowing machine comprising a sled-rigger assembly according to an embodiment of the present invention. The sled-rigger assembly of an embodiment of the present invention comprises a rigger assembly and a sled assembly. The rigger assembly comprises a rigger 4 and rigger mounts 7, an oar assembly, and backstays 10. For a sculling configuration (comprising 2 oars, etc.; a sweep configuration is also contemplated and comprises 1 oar, etc.), the oar assembly comprises two: pins 8, oarlocks 9, pin mounting slots 24, oar shafts 13, adjustable oar handles 14, oar sleeves 15, and oar clamps 16. The sled assembly comprises a sled 1, seat 11, seat tracks 12, sled bearings 23, shoe plate 25 and shoes 315, resistance mechanism assembly 5 (see, e.g., FIGS. 2, 5*a* and 5*b*), and resistance mechanism mount 6. The resistance mechanism assembly 5 comprises at least one: drive winch 40, carrier winch 41, ring gear 42, planetary gears 43, sun gear 44, drive winch-to-carrier winch clutch 45, carrier mounting and planetary axle screw 46, drive shaft 47, drive winch mounting bearing 48, planetary assembly mounting bearing 49, carrier plate 50, weight component of resistance mechanism 51, dampening component of resistance mechanism 52, clutching resistance mechanism mounting bearing 53, axle mounting bearing 290, and resistance mechanism retaining clamp 54. These elements of the sled rigger assembly according to an embodiment of the present invention will be described in further detail, infra.

In accordance with an embodiment of the present invention, the rigger 4 duplicates an actual rigger of an Olympic-class rowing shell in function and appearance and comprises a front portion 101 mounted to the rigger mount 7 by any acceptable fastening means (e.g., nuts and bolts, screws and the like), and in a sculling configuration—two intermediate portions 102 that distally extend at an acute angle from the longitudinal axis of the rowing machine towards the rear of the rowing machine to rear portions 103, which rearwardly extend in a direction parallel to the longitudinal axis of the rowing machine from the intermediate portion 102. The rigger mounts 7 act as an interface between a sled 1 and the front portion 101 of the rigger 4 at the front 100 of the rowing machine. Similarly to many Olympic-class rowing shells, the rigger mounts 7 allow for the rigger 4 to be adjusted forward or backward relative to the sled 1. The rigger mounts 7 can be modified to fit multiple rigger 4 configurations allowing the user the ability to use a preferred rigger 4.

In accordance with an alternative embodiment of the present invention, the rigger 4 can be fastened from the rear 200 (e.g., the "fluidesign" rigger, as should be appreciated by those skilled in the art) such that all cable and guides like the drive cable rigger guide 22 (as described infra) can be incorporated into the rigger 4. Additionally, the rowing machine of an embodiment of the present invention can incorporate a traditional "euro-rigger" in either steel, aluminum or composite material or carbon fiber and the like, or a "dreher rigger" design as opposed to a wing rigger design (as should be appreciated by those skilled in the art). In essence, any rigger configuration for a boat can be incorporated into the design of the rowing machine of an embodiment of the present invention.

In accordance with an embodiment of the present invention, the pins 8 act as an interface or connector between the rigger 4 and an oarlock 9. The portion of the oar that is closest to the user when the user is on the rowing machine is the adjustable oar handle 14. The adjustable oar handle 14 acts as an interface between a user and an oar shaft 13, and can be adjusted as with most Olympic-class rowing oars (as should be appreciated by those skilled in the art). The oar shaft 13 is distal to the oar handle and supports an adjustable oar handle 14 and oar-to-cable mount 17. The oar sleeve 15 surrounds a distal portion of the oar shaft and acts as an interface between the oar and the oarlock. The oarlock 9 acts as the interface between the oar sleeve and the pin 8. Each pin 8 is mounted in such a way that distance between pins 8, or between pins 8 and the longitudinal axis of the sled 1, can be adjusted just as with Olympic-class rowing shells (referred to as "changing the spread" by those skilled in the trade). The oar clamps 16 captivate the oar in the oarlock 9, and reside on both the "outboard" and "inboard" side of the oarlock 9 (unlike Olympic-class rowing shell which typically have an oar clamp 16 on the "inboard" side of the oarlock 9). The pin mounting slot 24 is an aperture in the rear portion 103 of the rigger 4 and in the drive cable rigger pulley mount 21 that allows for both the anchoring and adjusting of the pin 8. The backstay 10 stretches from the top of the pin 8 to a rear portion of the sled 1 (as shown in FIG. 1*a*) to support the pin 8 and overall rigger assembly just as it does with Olympic-class rowing shells.

In accordance with an embodiment of the present invention, the sled 1 is mounted on sled bearings 23 that ride on sled-shell interface shafts 30 that are mounted to the shell 2. The sled 1 replicates dimensions of the cockpit of a common Olympic-class rowing shell. The sled 1 supports the seat 11, seat tracks 12, resistance mechanism assembly 5 and resistance mechanism assembly mount 6, rigger 4 and rigger mounts 7, shoe plate 25 and shoes 315. The sled 1 is free to move forward and backward within the plane of motion along the longitudinal axis of the rowing machine, which is perpendicular to the plane of rotational motion of the shell 2, as discussed infra. This forward and backward motion is operable to allow for momentum, similar to that of an actual rowing shell, to be experienced by the user. A user's stroke is composed of a drive phase and recovery phase. The sled 1 is pulled forward by the sled drive cables 310 in the drive phrase. The sled 1 is pulled back to its starting position by both the recoil springs 305 and pulling force exerted on the shoe plate 25 by the user on the recovery phase (the drive phase and recovery phase are discussed further, infra).

In accordance with an embodiment of the present invention, the seat (slide) 11 comprises a sliding seat upon which a user sits (just as in any Olympic-class rowing shell), which slides backward and forward on seat tracks 12 in a direction along the longitudinal axis of the rowing machine of an embodiment of the present invention. The seat (slide) 11 is operable to keep the center of gravity of each rower stationary relative to the shell 2 as the components of the rowing machine of an embodiment of the present invention slide fore and aft under the user during the drive and recovery phases. This configuration allows the rower to feel like they are gliding and moving, when they are actually remaining stationary during the drive and recovery phases. The seat tracks 12 comprise tracks upon which seat rolls (just as in any Olympic-class rowing shell), which is connected to the top of sled 1 by any acceptable fastening means. The sled bearings 23 act as an interface between the sled 1 and the sled 1-shell 2 interface upon which the sled 1 travels back and forth in a longitudinal direction, as discussed supra. The shoe plates 25 act as a platform upon which the shoes 315 are anchored, as in any Olympic-class rowing shell. The rower is coupled to the sled 1 through the shoes 315 (as well as the rower's grasp on the oar assembly(ies)).

In accordance with an embodiment of the present invention, the drive phase of a user's stroke involves the user pushing on the shoes 315 on the shoe plate 25 and/or pulling on the adjustable oar handle 14. This action will result in the sled 1 moving forward (and weight and dampening component of resistance mechanism, 51 and 52, to rotate as discussed infra), and in the adjustable oar handle 14 rotating (from the pivot point of the pin 8) from a relative position at the front 100 of the rowing machine of an embodiment of the present invention to the rear 200 of the rowing machine. In accordance with an embodiment of the present invention, the recovery phase of the stroke involves the user returning the adjustable oar handle 14 to the relative position at the front 100 of the rowing machine of an embodiment of the present invention, and "pulling" the sled 1 back to its initial position as the user applies force with their feet on the shoes 315 on the shoe plate 25 in the opposite direction of what was performed in the drive phase. The user's center of mass stays relatively stationary relative to the shell 2 throughout both the drive and recovery phases while the sled 1 is free to move forward and back along the center line (longitudinal axis) of the rowing machine of an embodiment of the present invention.

In accordance with an embodiment of the present invention, the resistance mechanism assembly mount 6 couples the resistance mechanism assembly 5 to the sled 1 by attaching the resistance mechanism assembly 5 directly to the sled 1. The resistance mechanism assembly mount 6 effectively mounts and is operable to captivate the components of the resistance mechanism assembly 5.

In accordance with an alternative embodiment of the present invention, the resistance mechanism assembly 5 of an embodiment of the present invention can be mounted to the shell 2, by any acceptable mounting means. In this embodiment, the resistance mechanism assembly 5 is driven as the sled 1 moves relative to the fixed resistance mechanism assembly 5. The sled 1 would be driven in the same manner as discussed herein with reference to the other embodiments, that is, via a drive winch 40 and carrier winch 41 coupled with a drive winch to carrier winch clutch 45.

Figure 5A:
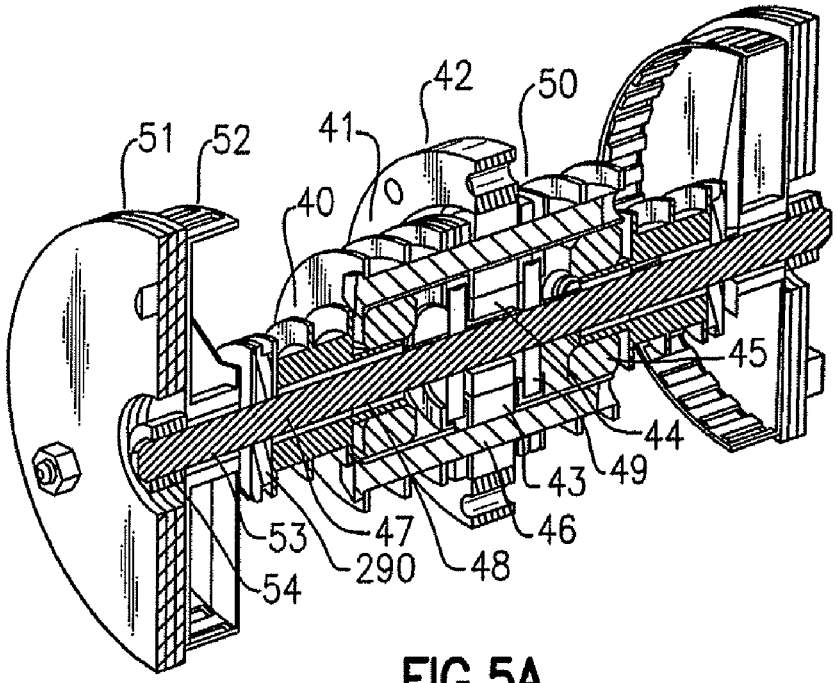
FIGS. 5*a*-5*b* are sliced perspective views that illustrate a resistance mechanism assembly of the rowing machine according to an embodiment of the present invention.
Figure 5B:
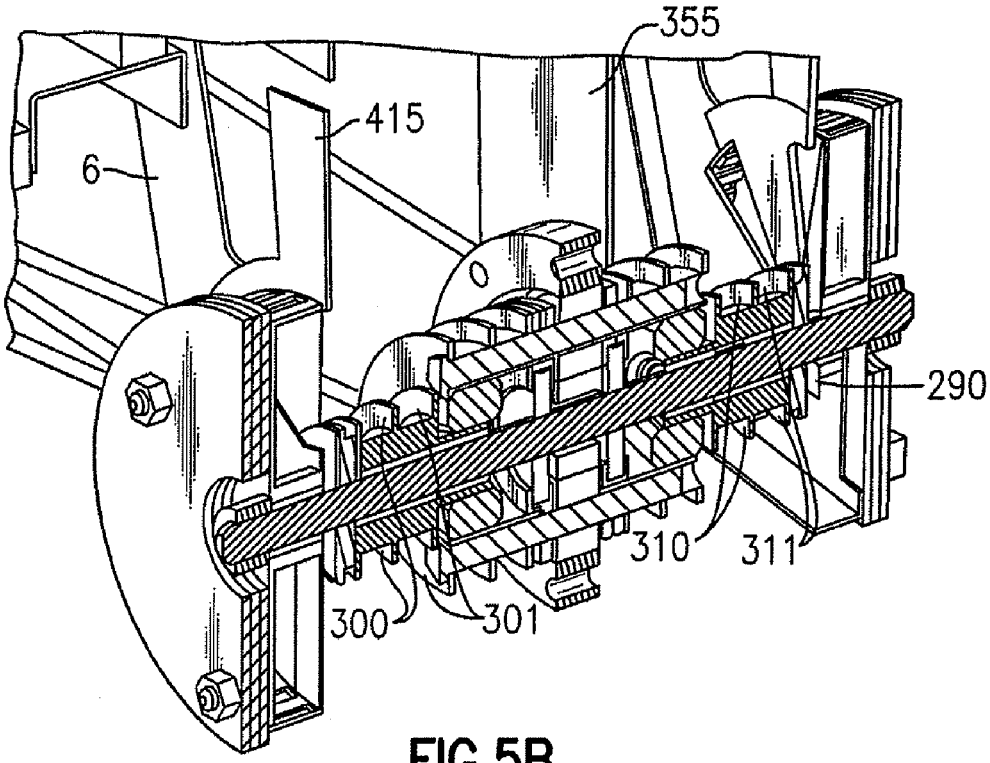
Figure 6:
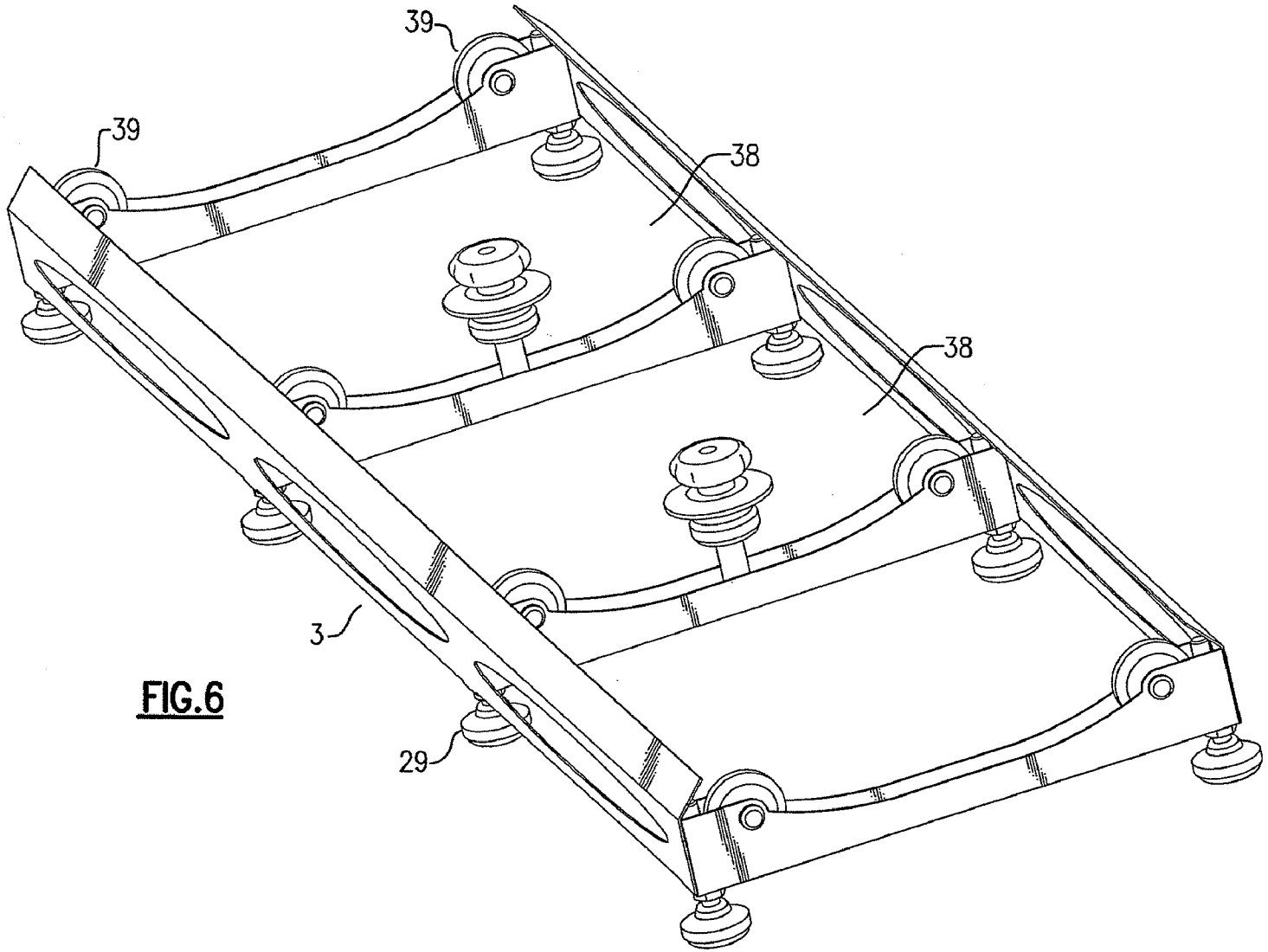
FIG. 6 is a top perspective view that illustrates part of the shell-base assembly of the rowing machine according to an embodiment of the present invention.
Figure 7:
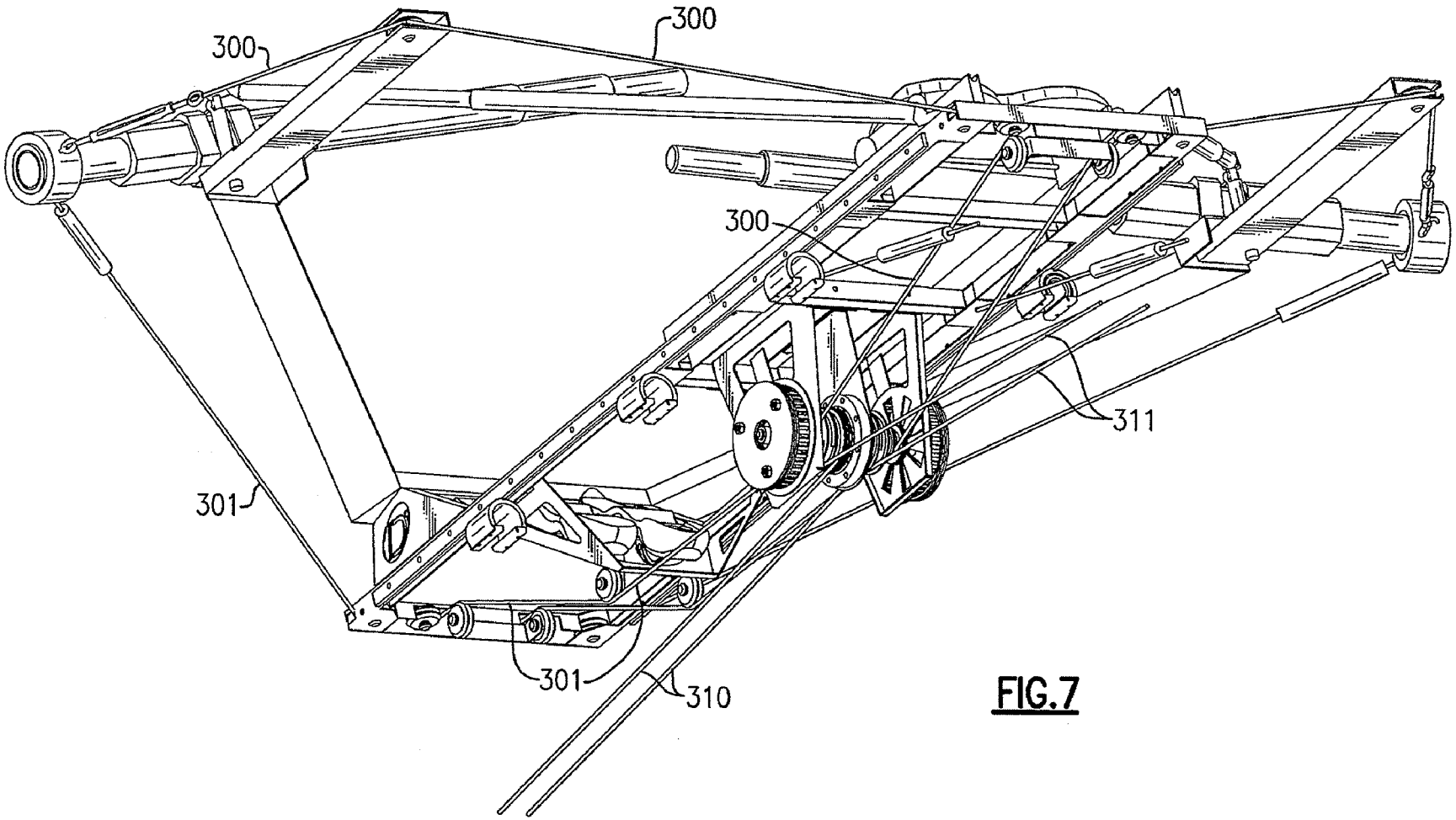
FIG. 7 is a bottom perspective view that illustrates the drive cable system and sled-drive cable system of the rowing machine according to an embodiment of the present invention.
Figure 8:
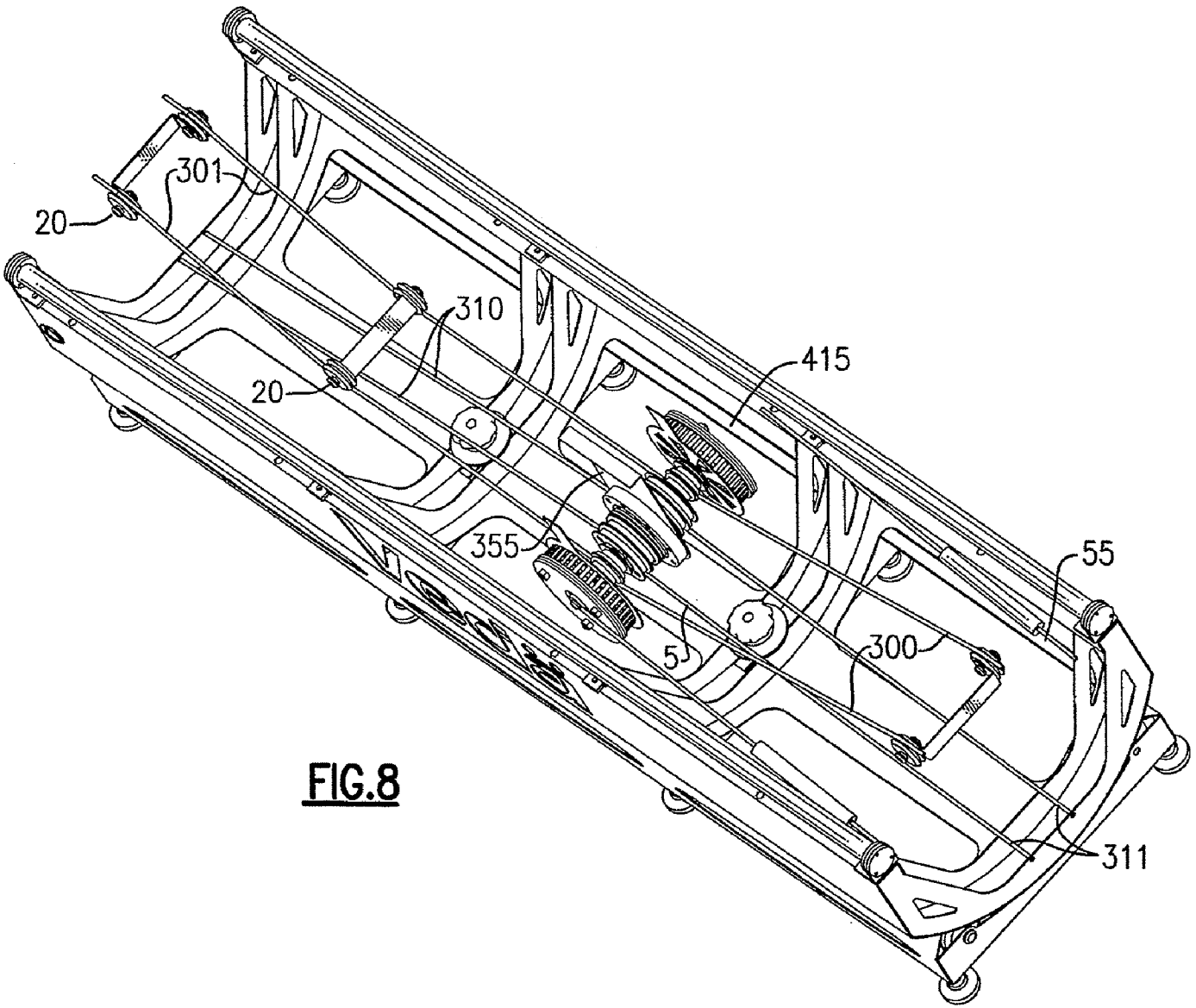
FIG. 8 is a top perspective view that illustrates a sled-drive cable system of the rowing machine according to an embodiment of the present invention.

In accordance with an embodiment of the present invention, FIGS. 5*a* and 5*b* show sliced perspective views along the longitudinal axis of the drive shaft 47 that illustrates a resistance mechanism assembly of the rowing machine according to an embodiment of the present invention. The resistance mechanism 5 simulates the feeling of resistance experienced by a rower in an Olympic-class rowing shell and will be discussed in further detail, infra.

In accordance with an embodiment of the present invention, the drive shaft 47 supports the resistance mechanism assembly 5. The axle mounting bearing 290 couples the resistance mechanism assembly 5 to the resistance mechanism mount 6 via the drive shaft 47 while allowing the drive shaft 47 to spin freely during both the drive and recovery phases. The resistance mechanism assembly 5 of an embodiment of the present invention comprises a point where the longitudinal axis of the rowing machine of an embodiment of the present invention intersects the resistance mechanism assembly 5. This point comprises the ring gear 42, which encompasses the planetary gears 43 and the sun gear 44. In a distal direction from this point, on either side of the resistance mechanism assembly 5, is the planetary assembly mounting bearing 49, followed by the carrier plate 50, carrier winch 41 which encompasses the carrier winch to drive winch clutch 45, drive winch 40 encompassing a drive winch mounting bearing 48, the dampening component of resistance mechanism 52 encompassing the clutching resistance mechanism mounting bearing 53 and coupled to weight component of resistance mechanism 51, and at the most distal point is the resistance mechanism retaining clamp 54.

In accordance with an embodiment of the present invention, the drive winch 40 couples the drive 300 and recovery cables 301 extending from the Oar assembly(ies). (See generally, FIGS. 1*b*, 1*c*, 2, 3, 5*b*, 7 and 8 regarding illustrations of the drive cable assembly of an embodiment of the present invention, as described infra) The drive winch 40 acts as the interface between the user, their oar, and the resistance mechanism assembly 5. The drive winch 40 is operable such that when driven in the drive phase, the drive cable 300 is unwound while the recovery cable 301 is wound; and when the user is "recovering" between strokes in the recovery phase, the recovery cable 301 is unwound while drive cable 300 is wound. The carrier winch 41 couples the resistance mechanism assembly 5, and thus the sled 1, to the shell 2. The carrier winch 41 is also operable to couple the drive winch 40 to the planetary gears 43 via the drive winch-to-carrier winch clutch 42. As carrier winch 41 spins, it spins the planetary gears 43. In the drive phase of the stroke, the carrier winch 41 accumulates sled-drive cable 310 in such a way that it pulls the sled 1 forward. In the recovery phase of the stroke, the carrier winch 41 lets out sled-drive cable 310 in such a way that it is always ready to switch between the Drive and Recovery phase. In the drive phase of the stroke, the carrier winch 41 lets out sled-recovery cable 311 in such a way that it is always ready to switch between the Drive and Recovery phase. In the recovery phase of the stroke, it accumulates sled-recovery cable 311 in such a way that it is always ready to switch between the Drive and Recovery phase (as the sled-recoil mechanism 305 works to "reset the sled" for the start of another drive phase). While the sled-recovery cable 311 plays a relatively "passive role" when rowing machines of an embodiment of the present invention are uncoupled, the sled-recovery cable 311 plays an active role when rowing machines are coupled; the sled-recovery cable 311 creates resistance on the carrier winch 41 when the sled 1 is driven by any other coupled rowing machine as it cannot be let out without the carrier winch 41 spinning. This action works to provide both additional resistance to coupled rowing machines and to potentially override the resistance mechanism assembly 5 in such a way that the user feels less resistance when their sled 1 is being driven by users on coupled rowing machines. The ring gear 42 is anchored in position relative to the sled 1 by the ring gear mount 355 in such a way as to allow the planetary gears 43 to drive the sun gear 44 when the planetary gears 43 are driven by the carrier winch 41. The planetary gears 43 are anchored to the carrier winch 41 by the carrier mounting and planetary axle screws 46 in such a way as they move in accordance with the carrier winch 41. The sun gear 44 is either mounted to or is part of the drive shaft 47 such that when driven, it spins the drive shaft 47. The drive winch-to-carrier winch clutch 45 is operable to couple and decouple the drive winch 40 to the carrier winch 41 in a predictable manner by the user through movement of the oar. The drive winch-to-carrier winch clutch 45 is designed such that (1) it can be driven from the drive winch 40 in only one direction (e.g., clockwise) and (2) freely spins in the other (e.g., counter-clockwise) and (3) allows the carrier winch 41 to overrun in both clockwise and counter-clockwise directions. The carrier mounting and planetary axle screws 46 are operable to tie the carrier winches 41 together as well as to the planetary gears 43. The drive shaft 47 supports the resistance mechanism assembly 5 and is operable to drive both the weight component of resistance mechanism 51 and the dampening component of resistance mechanism 52. The drive winch mounting bearings 48 allow for the drive winch 40 to freely ride on the drive shaft 47 in both clockwise and counter clockwise directions. The planetary assembly mounting bearings 49 are mounted in such a way that they are operable to keep the carrier winches 41 and planetary gears 43 orthogonal to the drive shaft 47. The carrier plates 50 are operable to captivate the contents of the carrier winch 41, the planetary gears 43 and the planetary assembly mounting bearings 49. The weight component of resistance mechanism 51 provides both resistance and momentum to the resistance mechanism assembly 5. The weight component of resistance mechanism 51 is operable to be adjusted by adding or removing plates that compose the weight component of the resistance mechanism 51, and/or by increasing or decreasing it's weight by using heavier or lighter materials for its composition (e.g., aluminum, plastics, etc.). The dampening component of resistance mechanism 52 is operable to provide resistance to the resistance mechanism assembly 5 while driven as well as when it is not being driven. The dampening component of resistance mechanism 52 is coupled to the weight component of resistance mechanism 51 in such a way as to reduce its momentum when not being driven. The dampening component of resistance mechanism 52 can be composed of either a wind/blower-wheel, the resistance of which can be adjusted by adjusting a dampening mechanism or adjustable vent 415, or a frictional resistance mechanism which can be adjusted in such a manner that more or less friction can be imposed upon it. The clutching flywheel mounting bearings 53 are operable to mount the weight 51 and dampening component of resistance mechanisms 52 to the drive shaft 47 in such a way that they are coupled to the drive shaft 47 when driven in only one direction. The flywheel retaining clamps 54 are operable to captivate either the resistance mechanism assembly 5, or only the weight 51 and dampening component of resistance mechanisms 52, depending on the configuration.

In accordance with an embodiment of the present invention, as shown in FIGS. 1*b*, 1*c*, 2, 3, 5*b*, 7, and 8, parts or the entire drive cable assembly of an embodiment of the present invention is shown. The drive cable assembly of an embodiment of the present invention comprises a drive cable system comprising a drive cable 300 and a recovery cable 301, and a sled-drive cable system comprising a sled-drive cable 310 and a sled-recovery cable 311.

In accordance with an embodiment of the present invention, the drive cable 300 stretches from the distal end of the oar assembly to the drive winch 40 via the rear 200 of the rowing machine of an embodiment of the present invention, and the recovery cable stretches from the distal end of the oar assembly to the drive winch 40 via the front 100 of the rowing machine of an embodiment of the present invention. The drive cable system drives the carrier winch 41.

In accordance with an embodiment of the present invention, the sled-drive cable 310 stretches from the carrier winch 41 to the front 100 of the rowing machine of an embodiment of the present invention, and the sled-recovery cable 311 stretches from the carrier winch 41 to the rear 200 of the rowing machine of an embodiment of the present invention. The sled-drive cable system drives the sled 1 and the weight 51 and dampening component of resistance mechanisms 52.

In accordance with an embodiment of the present invention, the drive cable assembly further comprises oar-to-cable mount 17, drive cable length adjuster 18, recovery cable length adjuster 390, recovery cable flexor 19, drive cable flexor 379, drive cable rigger guide pulley mount 21, drive cable rigger guide 22, front (stern) recovery cable guide 26, internal recovery cable guide 27, rear (bow) drive cable guide 28, front internal recovery cable guide 20, rear internal drive cable guide 55, rear (bow) sled-recovery adjustable cable mounts 34, front (stern) sled-drive adjustable cable mount 35, and front (stern) sled drive cable flexor 36. The recovery cable length adjuster 390 and drive cable length adjuster 18 allow the user to keep proper tension in the recovery cable 301 and drive cable 300. These elements of the drive cable assembly according to an embodiment of the present invention will be described in further detail, infra.

In accordance with an embodiment of the present invention, the drive cable 300 is operable to connect the oar assembly to the drive winch 40. The oar-to-cable mount 17 acts as an interface between the oar assembly and the drive cable length adjuster 18. The oar-to-cable mount 17 is operable to allow for the end of the oar-cable interface to rotate as needed throughout a user's stroke, while also allowing the user to simulate the "feathering motion" required in the rowing stroke (as should be appreciated by those skilled in the art). The drive cable length adjuster 18 acts as an interface between the drive cable 300 and the oar-to-cable mount 17. The drive cable length adjuster 18 is operable to allow the user to easily adjust the length of the drive cable 300 as adjustments to the rigger configuration, as discussed supra, are made. The recovery cable flexor 19 is operable to allow for necessary flexing of a relatively inelastic recovery 301 and drive cable 300 (or belt mechanism in accordance with an alternative embodiment of the present invention). The drive cable flexor 379, a heavier mechanism than that of the recovery cable flexor 19, is operable to allow for necessary flexing of a relatively inelastic drive cable 300 (or belt mechanism in accordance with an alternative embodiment of the present invention) only when a given force generated by the user is exceeded. This mechanism is operable to both simulate the "slipping motion" of an oar through fluid when overloaded and to protect all support and cable guide mechanisms of the rowing machines of embodiments of the present invention from being overloaded. The drive cable rigger guide pulley mount 21 supports the drive cable rigger guide pulley 22. The drive cable rigger guide pulley 22 guides and supports the drive cable 300.

In accordance with an embodiment of the present invention, the front (stern) recovery cable guides 26 are operable to carry the recovery cable 301 from the recovery cable flexor 19 to the internal recovery cable guides 27. The internal recovery cable guides 27 are operable to direct the recovery cable 301 from the front (stern) recovery cable guide 26 to drive the drive winch 40. The rear (bow) drive cable guides 28 are operable to carry the drive cable 300 from the drive cable flexor 379 to the rear internal drive cable guides 55 in the rear 200 of the sled 1 and then to the drive winch 40. The rear internal drive cable guides 55 are operable to direct the drive cable 300 from the rear (bow) drive cable guides 28 to drive the drive winch 40.

The rear (bow) sled-recovery adjustable cable mounts 34 provide an anchor system for cable adjustment for the sled-recovery cable 311 in the rear 200 of the rowing machine of an embodiment of the present invention. The front (stern) sled-drive adjustable cable mount 35 provides an anchor system for cable adjustment for the sled-drive cable 310 in the front 100 of the rowing machine of an embodiment of the present invention. The front (stern) sled-drive cable flexor 36 provides necessary flexion in the sled-drive cable 310 given the relative inelasticity of the sled-drive cable 310 and the system in general.

In accordance with an embodiment of the present invention, as shown in FIGS. 1*b*, 3, 4, and 6, the shell-base assembly of an embodiment of the present invention comprises a shell 2, base 3, adjustable base feet 29, shell-sled interface shaft 30, shell-sled interface shaft inner mounts 31, shell-sled interface shaft end mounts 32, double shell ribs 33, retaining slots 37, wheel-shell captivator and dampener 38, and base-shell interface rollers 39. These elements of the shell-base assembly according to an embodiment of the present invention will be described in further detail, infra.

In accordance with an embodiment of the present invention, the shell 2 sits on a set of base-shell interface rollers 39 mounted to the base 3. The shell 2 replicates the general shape of shell of a common Olympic-class rowing shell. The shell 2 supports the sled-shell interface shafts 30. (The sled 1 moves along these shell interface shafts 30 along the longitudinal axis of the rowing machine of an embodiment of the present invention, as noted supra.) The shell 2 is free to move rotationally in either a "clock-wise" and "counter clock-wise" direction within the plane of motion that is perpendicular to that of the sled 1. This is achieved by the shell 2 being mounted on the base-shell interface rollers 39. This motion is designed to allow for the possible "side-to-side rocking motions," similar to those experienced in an actual rowing shell, to be experienced by the user. This motion is bounded by the wheel-shell captivator and dampener mechanism 38 and controlled in regard to freedom of movement by the wheel-shell captivator and dampener mechanism 38. This wheel-shell captivator and dampener mechanism 38 also combines to fully captivate the shell 2 to the base 3.

In accordance with an embodiment of the present invention, the base 3 functions as the interface between a relatively flat surface on which the rowing machine of an embodiment of the present invention is required to sit, and the curved surface of the shell 2. The base 3 contains enough weight such that it "anchors" the entire rowing machine via the wheel-shell captivator and dampener mechanism 38, which the base 3 supports. The adjustable feet 29 allow for the base 3 to adapt to irregularities of most flat surfaces such as floors. The base 3 also contains the base-shell interface rollers 39 on which the shell 2 sits and is free to move, as discussed supra.

In accordance with an embodiment of the present invention, the adjustable base feet 29 enable the user to adjust the positioning of the base 3 given irregularities in the surface, or given the need for general alignment when the rowing machines of an embodiment of the present invention are joined. The shell-sled interface shaft 30 provides a platform for the sled 1 to move forward and backward within the plane of motion along the longitudinal axis of the rowing machine, as discussed supra. The shell-sled interface shaft inner mounts 31 support the shell-sled interface shaft 30, while allowing for the sled linear bearings 23 to travel uninterrupted along the total length of the shell-sled interface shaft 30. The shell-sled interface shaft end mounts 32 support the shell-sled interface shaft 30 while captivating the movement of the sled 1. The double shell ribs 33 provide stability to the shell 2 while offering added rigidity to the skin 400 of the shell 2 given the nature of the interface with the base 3. The retaining slots 37 captivate the shell 2 in such a way as to stop it from rolling beyond a given number of degrees, e.g., 0-25 degrees. The wheel-shell captivator and dampener 38 is operable to be adjusted by the user such that the user can control the freedom of rotational movement of the shell 2.

In accordance with an embodiment of the present invention, the base shell interface rollers 39 create an interface between shell 2 and base 3 while allowing for the "rolling" motion of the shell 2, as discussed supra.

In accordance with an embodiment of the present invention, the resistance mechanism assembly 5 of an embodiment of the present invention is operable to produce resistance by using a weight and/or frictional mechanisms. Resistance can be adjusted by either adding weight to the weight component of resistance mechanism 51 or by adjusting airflow via an adjustable vent 415 to the dampening component of resistance mechanism 52 (e.g., concept 2, as should be appreciated by those skilled in the art). The invention also contemplates resistance being adjusted by a dampening system which utilizes frictional forces applied directly the weight component of resistance mechanism 51, which should be appreciated by those skilled in the art (e.g., Gjesing erg, Gamut erg). The drive winch 40 and carrier winch 41 dimensions can be adjusted in a manner that either reduces or increases the amount of travel and rotations per minute, thus amount of resistance, produced by the weight 51 and dampening component resistance mechanisms 52. Additionally, adjustments to the overall ratios of the planetary assembly (through typical replacement of differently sized sun 44, planetary 43 and ring gears 42) can be made such that the rotations per minute of the dampening 52 and weight component of the resistance mechanisms 51 can be adjusted in order to increase or decrease resistance to the user.

In accordance with an embodiment of the present invention, the resistance mechanism assembly 5 of an embodiment of the present invention is operable to allow the user to engage or disengage from the resistance mechanism assembly 5 by both directing and applying force in a similar manner done within an actual rowing shell. The forces generated by the user are transferred to the resistance mechanism assembly 5 when the user is "pulling on" the adjustable oar handles 14 and/or pushing on the shoe plates 25 (drive phase). All forces of the user are decoupled from the resistance mechanism assembly 5 when the user is "recovering" between strokes or not applying force to the adjustment oar handles 14 (recovery phase).

In accordance with an embodiment of the present invention, the resistance mechanism assembly 5 of an embodiment of the present invention is operable to allow the ratios among the sun gear 44, planetary gears 43 and ring gears 42 to be adjusted such that the relative rotations per minute of the resistance mechanism assembly 5 per rotation of the drive winch 40 can be increased or decreased.

In accordance with an embodiment of the present invention, the resistance mechanism assembly 5 of an embodiment of the present invention comprises a fully symmetrical configuration allowing for the same amount of resistance to be felt by the user whether the user is rowing in a Sculling (2 oars driving two drive winches 40) or Sweep (1 oar driving one drive winch 40) configuration.

In accordance with an embodiment of the present invention, the resistance mechanism assembly 5 of an embodiment of the present invention can be mounted to the sled 1 such than any forward, or drive-directed motion of the sled 1 implies resistance to the user. This resistance is felt by both the user of a specific rowing machine of an embodiment of the present invention, as well as by users of any coupled rowing machine, as noted supra. Alternatively, the resistance mechanism assembly 5' can be mounted to the structure of the shell 2, as generally shown in FIGS. 13-19, which are discussed infra.

In accordance with an embodiment of the present invention, the resistance mechanism assembly 5 of an embodiment of the present invention is operable to allow for the rotational motion of the oars and linear motion of the drive cable system and sled-drive cable system to be directly translated to linear motion of the sled 1 via the drive winch 40 and carrier winch 41.

In accordance with an embodiment of the present invention, the resistance mechanism assembly 5 of an embodiment of the present invention is operable to allow for gyroscopic forces to be felt by the user such that the faster the resistance mechanism assembly 5 spins, the more stabilizing or potentially destabilizing the effect on the rotational motion of the shell 2.

In accordance with an embodiment of the present invention, a method of using the rowing machine of an embodiment of the present invention is provided. The method of using the rowing machine of an embodiment of the present invention comprises a drive and recovery phase, as discussed briefly supra.

In accordance with an embodiment of the present invention, the drive phase comprises the steps of beginning a stroke by pulling on the adjustable oar handles 14 which pulls the drive cables 300 to spin the drive winch 40. The drive winch 40 engages the drive winch-to-carrier winch clutch 45 to drive the carrier winch 41, coupling said drive winch 40 with said carrier winch 41. The spinning of the drive winch 40 spins the carrier winch 41, wherein the spinning of the carrier winch 41 spins the planetary gears 43 around the inside of the ring gear 42 which is fixed in place by the ring gear mount 355. The spinning of the planetary gears 43 spins the sun gear 44 which is mounted directly to the drive shaft 47, spinning the drive shaft 47, wherein said drive shaft 47 spins freely within all bearings of the resistance mechanism assembly 5 except for the clutching flywheel mounting bearings 53. The clutching flywheel mounting bearings 53 couple the drive shaft 47 to the weight 51 and dampening component of resistance mechanisms 52, thereby driving said weight 51 and dampening component of resistance mechanisms 52, and moving the sled 1 in a forward direction as sled-drive cable 310 is taken up (or wound up around) by the carrier winch 41. A back end of the sled-recovery cable 311 is let out of (or unwound from) the carrier winch 41, finishing the stroke and completing the drive phase.

In accordance with an embodiment of the present invention, the recovery phase begins upon completion of the drive phase or decoupling of the drive winch 40 from the carrier winch 41 via the releasing and bi-directional over-running functionality of the drive winch-to-carrier winch clutch 45. The recovery phase comprises the steps of reversing the pulling motion on the adjustable oar handles 14, reversing the direction of the drive winch 40 which releases the drive winch-to-carrier winch clutch 45 (thus it becomes decoupled) from the carrier winch 41 and spins freely. The recoil springs 305 are loaded (which are mounted to the sled 1 and no longer have resistance on them) via their extension, wherein the recoil springs 305 recoil and drive the sled 1 in a backward direction (plus the user is "pulling themselves forward" via the shoes 315 and shoe plate 25, but this results in the user actually pulling the sled 1 back towards themselves). Given the configuration of the sled-drive cable 310 and the sled-recovery cable 311 around the carrier winch 41, this recovery motion of the sled 1 during the recovery phase turns the carrier winch 41 in the opposite direction (direction opposite to the spinning direction occurring in the drive phase, as discussed supra), thus turning the planetary gears 43, in the opposite direction. This also spins the drive shaft 47 in the opposite direction. The weight 51 and dampening component of resistance mechanisms 52, however, continue to spin in the same direction as in the drive phase, because the weight 51 and dampening component of resistance mechanisms 52 are mounted to the clutching flywheel mounting bearings 53 which couple the drive shaft 47 to the weight 51 and dampening component of resistance mechanisms 52 in only one direction. The sled-drive cable 310 around the carrier winch 41 is let out from the front end 100 of the rowing machine of an embodiment of the present invention and the sled-drive recovery cable 311 is taken in on the back end of the rowing machine 200, as the sled 1 reverses direction from the direction established during the drive phase.

Figure 9:
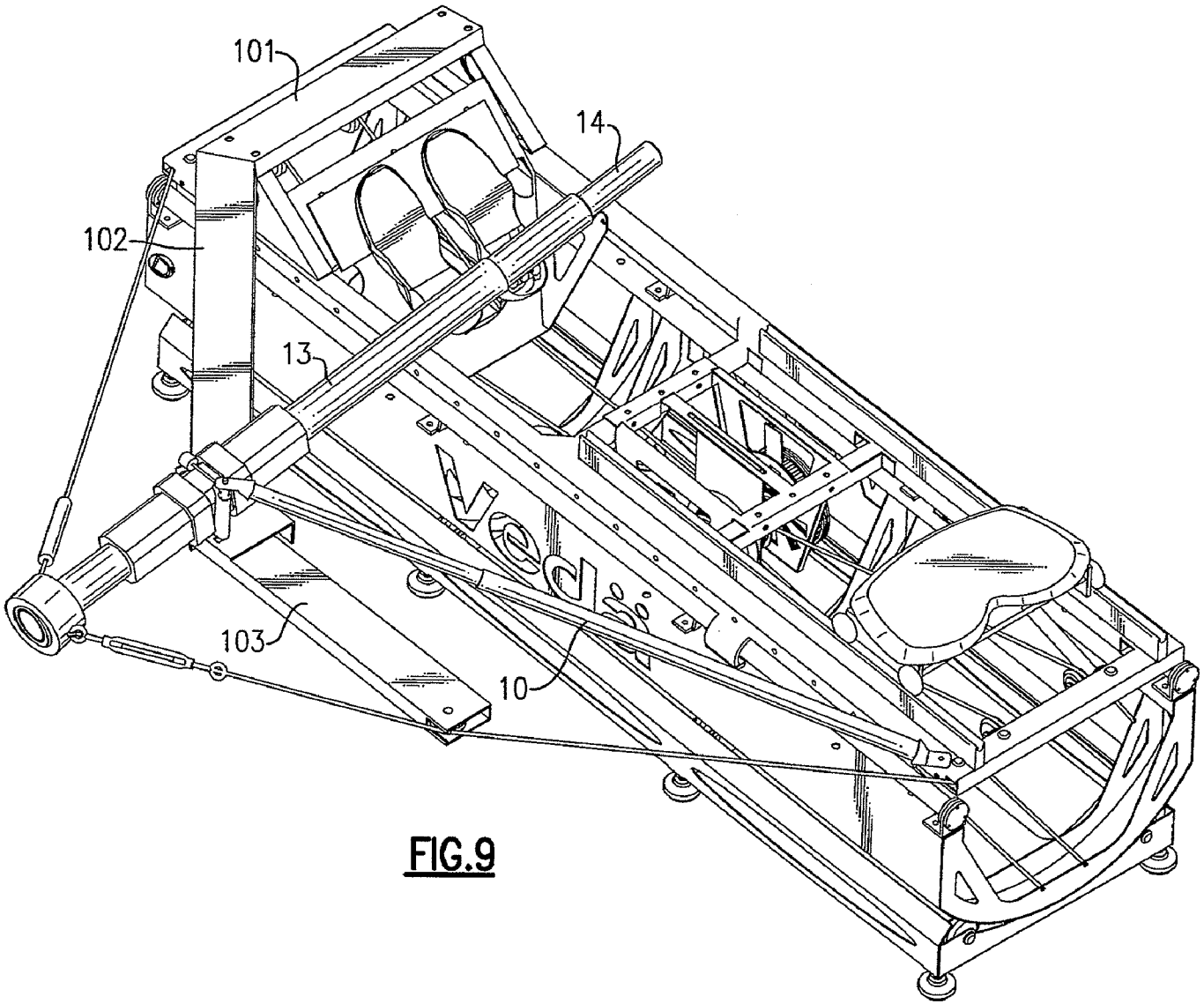
FIG. 9 is a top perspective view that illustrates rowing machine comprising a full sweep assembly according to an embodiment of the present invention.
Figure 11:
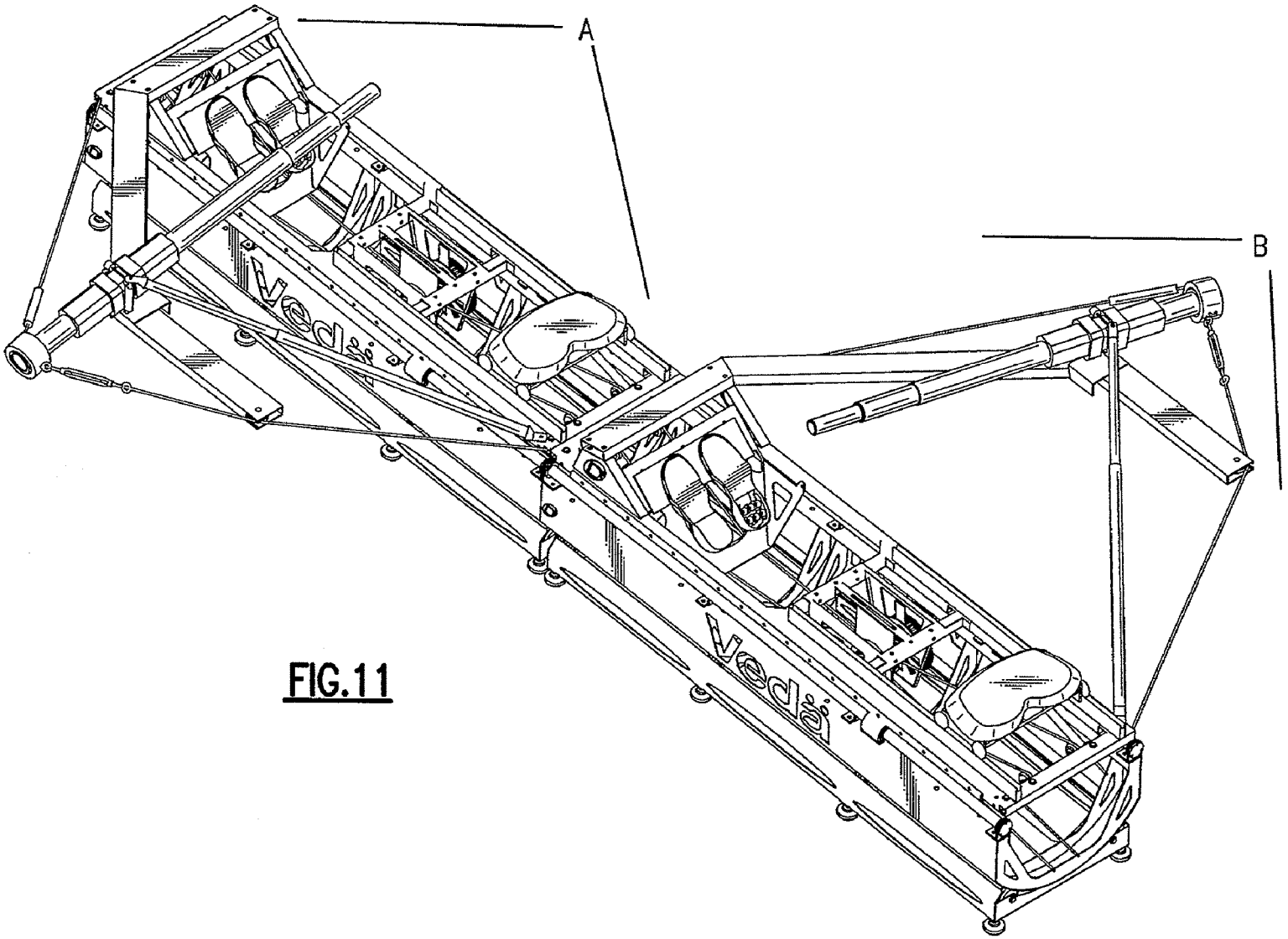
FIG. 11 is a top perspective view that illustrates two joined rowing machines in a full sweep assembly according to an embodiment of the present invention.
Figure 12:
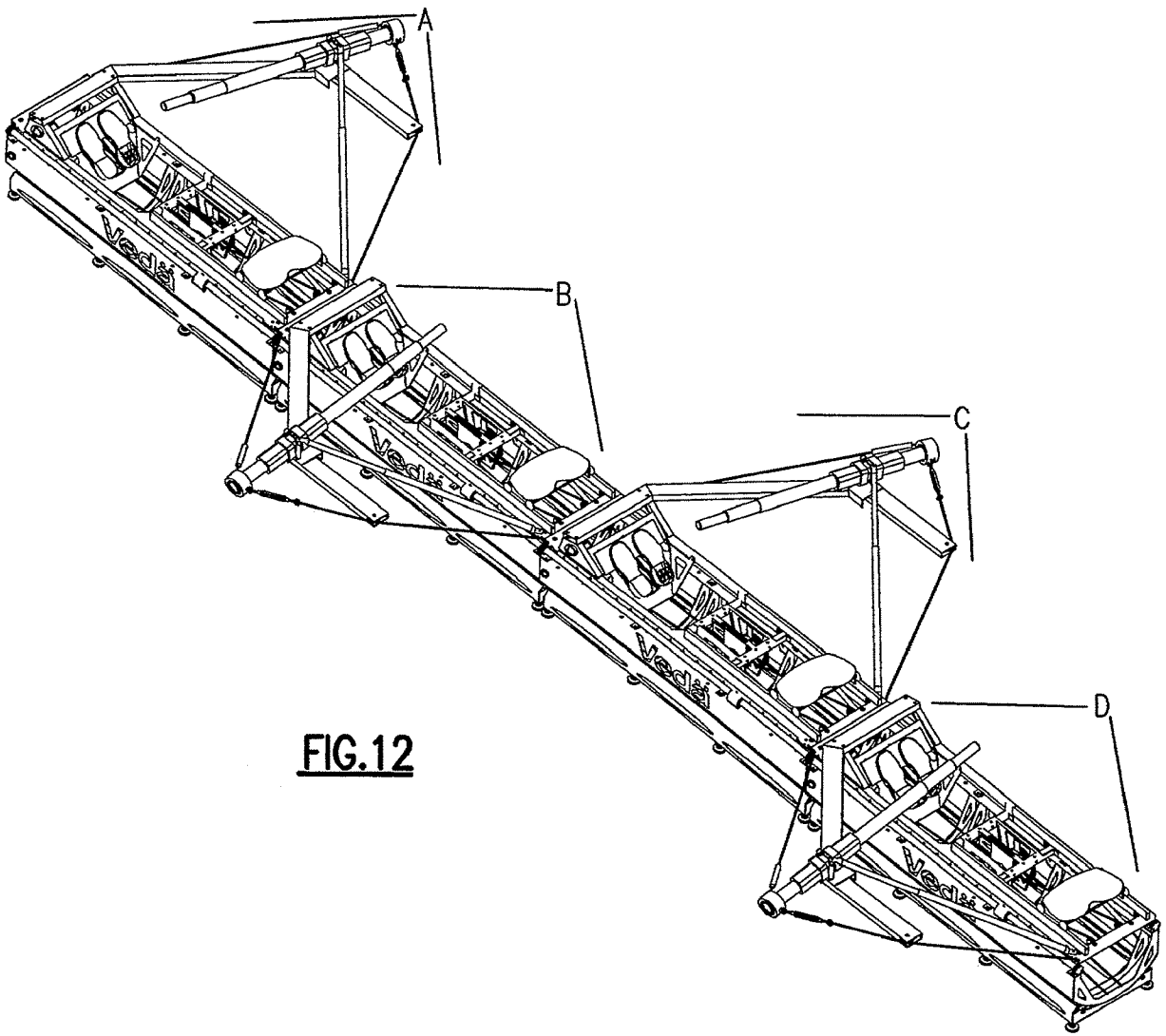
FIG. 12 illustrates four joined rowing machines in a full sweep assembly according to an embodiment of the present invention.

FIG. 9 shows a top perspective view that illustrates rowing machine comprising a full sweep assembly according to an embodiment of the present invention. The full sweep assembly comprises a single oar assembly and can be placed on either side of the rowing machine of an embodiment of the present invention, just like that of an actual rowing shell (as should be appreciated by those skilled in the art). FIG. 11 illustrates two joined rowing machines (A and B) in a full sweep assembly according to an embodiment of the present invention. FIG. 12 illustrates four joined rowing machines (A-D) in a full sweep assembly according to an embodiment of the present invention. As noted infra, other joined configurations of rowing machines of an embodiment of the present invention are contemplated.

Figure 10:
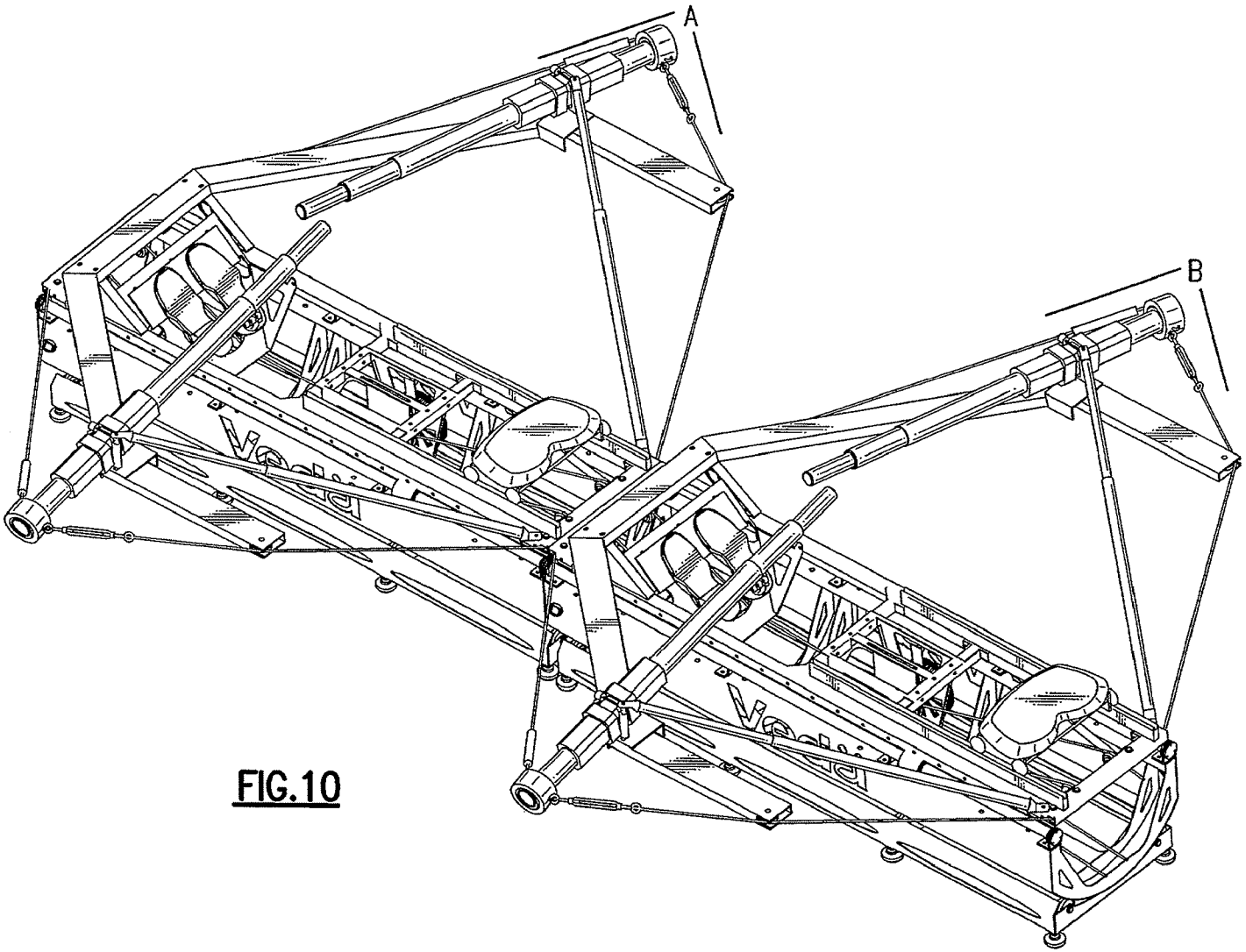
FIG. 10 is a top perspective view that illustrates joined rowing machines (double (2×) configuration) according to an embodiment of the present invention.

FIG. 10 shows a top perspective view that illustrates joined rowing machines (A and B) (double (2×) configuration) according to an embodiment of the present invention. Other joined configurations of rowing machines of an embodiment of the present invention are contemplated including 1×, 1+, 2×, 4×, 2−, 4−, 8+, and the like, as will be appreciated by those skilled in the art.

In an alternative embodiment, an alternative resistance mechanism assembly can be mounted to the structure of the shell 2, as generally shown in FIGS. 13-18. This embodiment basically de-couples the resistance mechanism assembly from the sled-drive mechanism, as described supra. That is, the resistance mechanism assembly is based directly on the movement of the sled 1, as opposed to the rate of rotation of the drive winch 40, as described supra.

The main components of this alternative embodiment of the resistance mechanism assembly can comprise one or more of the following: a frame of the resistance mechanism assembly 500, a flywheel 501, a winch 502 with one way clutche(s) 506 (that could be needle bearings or otherwise), a planetary gear box 507 (or any gearing type mechanism that functions to maximize the rotations per minute of the flywheel), a drive shaft 509, an out-put shaft 508 (an embodiment of which could include a one-way clutch that works to drive and release the flywheel, i.e., it would be mounted to the drive shaft 509), various thrust bearings to reduce friction 510 (or any embodiment which works to reduce friction), a drive pulley 504, and a release pulley 503. The flywheel 501 is shown as a solid mass that can be adjusted by the user by removing or adding layers. Further embodiments of the flywheel 501 could include, however, a flywheel more akin to a blower-wheel found in most common machines like the Concept 2 Rowing Machine. This type of flywheel 501 could be adjusted by varying the cubic feet of air the wheel could move.

This alternative embodiment of the resistance mechanism assembly creates resistance against any forward or "drive" movement of the sled 1 by virtue of a strap or cable 520 that can run from the sled 1, to the drive pulley 504 and around the winch 502. This cable or strap 521 can run from sled 1 to the release pulley 503 and around the winch 502 in a separate compartment from that which houses the strap or cable 520 running from the drive pulley 504. As one cable or strap winds, the other unwinds and visa-versa.

Figure 17:
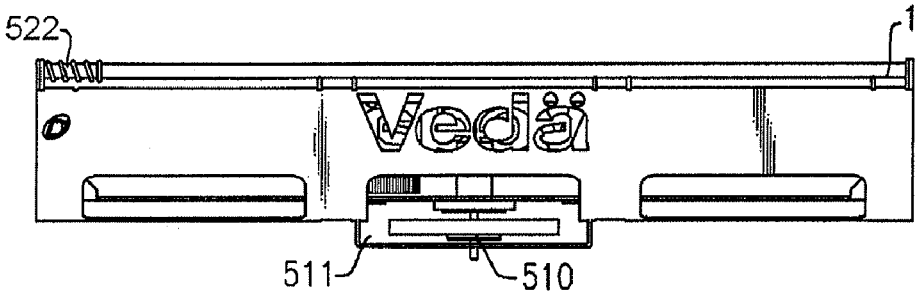
FIG. 17-18 are a side perspective views that illustrate a resistance mechanism assembly rotatably mounted to the structure of the shell, in accordance with an alternative embodiment of the present invention.
Figure 18:
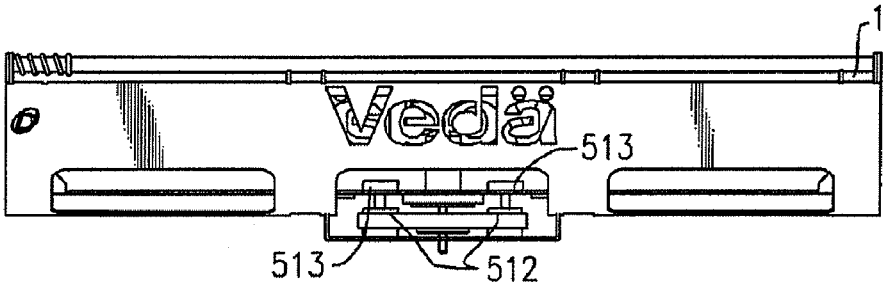

[As shown in FIG. 17, in addition to the resistance caused by the rotational inertia of the flywheel 501, an additional embodiment includes a friction element 511 that can create friction with the flywheel 501 on the flywheel's 501 diameter. This resistance can be created by a blower-wheel 505, the resistance of which can be gauged by adjusting air resistance as described above, which interfaces with the diameter of the flywheel 501 via a friction element 511. The friction element 511, shown in FIG. 17, is an elongated member that is interconnected to the blower wheel 505. An additional embodiment includes a friction plate 512 that can press down on or squeeze the flywheel 501 via a calibrated weight 513, as shown in FIG. 18. The calibrated weight 513 can be used to gauge the degree of additional frictional resistance. Any additional contemplated embodiments of the flywheel should work to create resistance against the sled 1 while creating gyroscopic, stabilizing forces.

An additional alternative embodiment of the resistance mechanism assembly 5 can include a flywheel 501 rotatably mounted to the sled 1, as discussed supra, however, the sled 1 can be decoupled from the shell 2. The rowing specific environment of this embodiment differentiates it from other previous inventions, e.g., Gamut erg. In particular, with respect to this embodiment of the present invention, the sled 1 moves due to inertial forces generated by the user pulling on the oar assembly against the resistance mechanism assembly while pushing on the foot-plate 315. The recoil of the sled 1 is created by the user pulling on the foot-plate 315 on the recovery motion to ready themselves for the next stroke phase. This would essentially be allowed for by the removal of the sled-drive 310 and sled-recovery 311 cables shown in FIG. 2.

Figure 13:
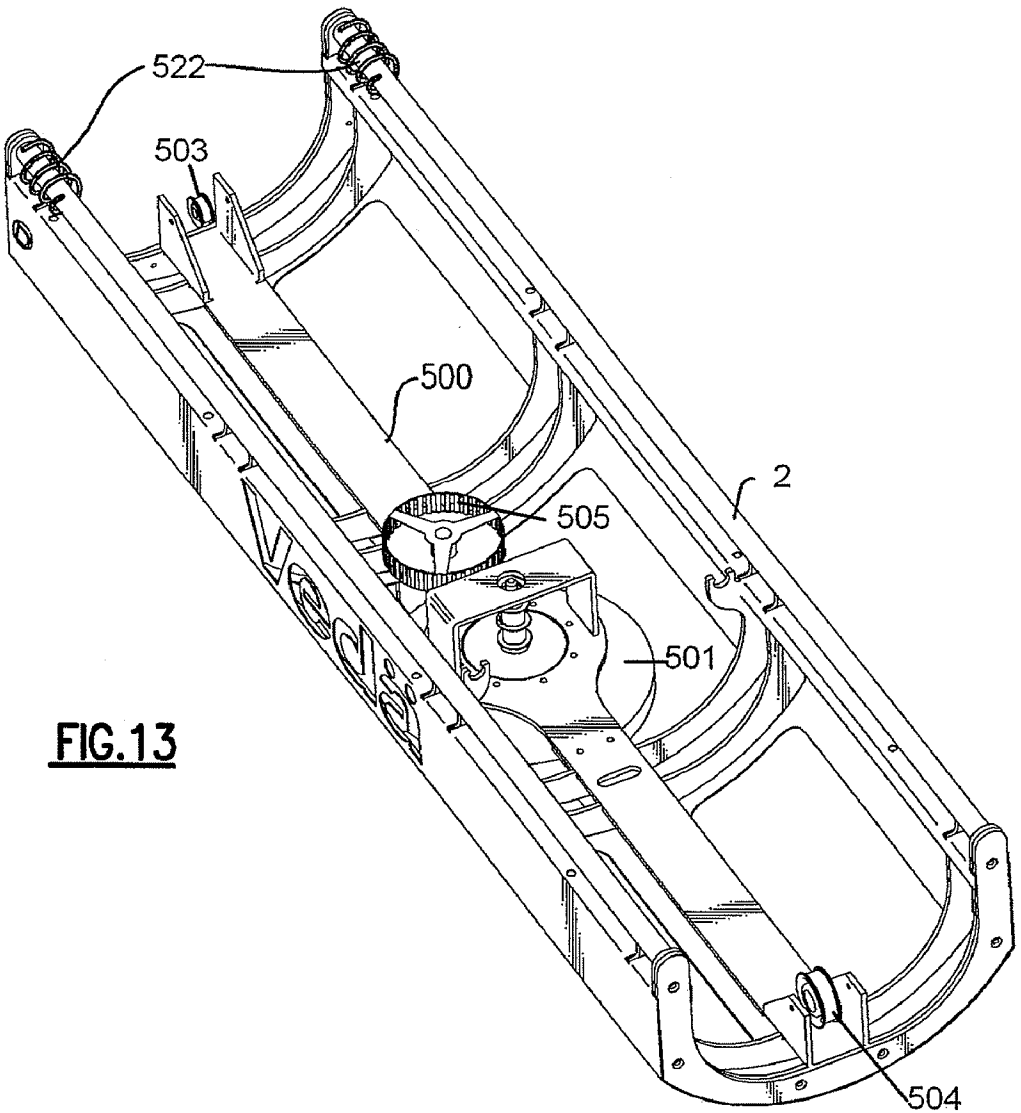
FIG. 13 is a top perspective view that illustrates a resistance mechanism assembly rotatably mounted to the structure of the shell, in accordance with an alternative embodiment of the present invention.

An alternative embodiment of the sled-recoil mechanism 305' is shown in FIG. 13. For example, as shown, spring(s) 522 can be slipped onto the sled-shell interface shafts 30. This sled-recoil mechanism 305' can work to recoil the sled 1 when the sled 1 is in the most extreme, forward position.

Figure 14:
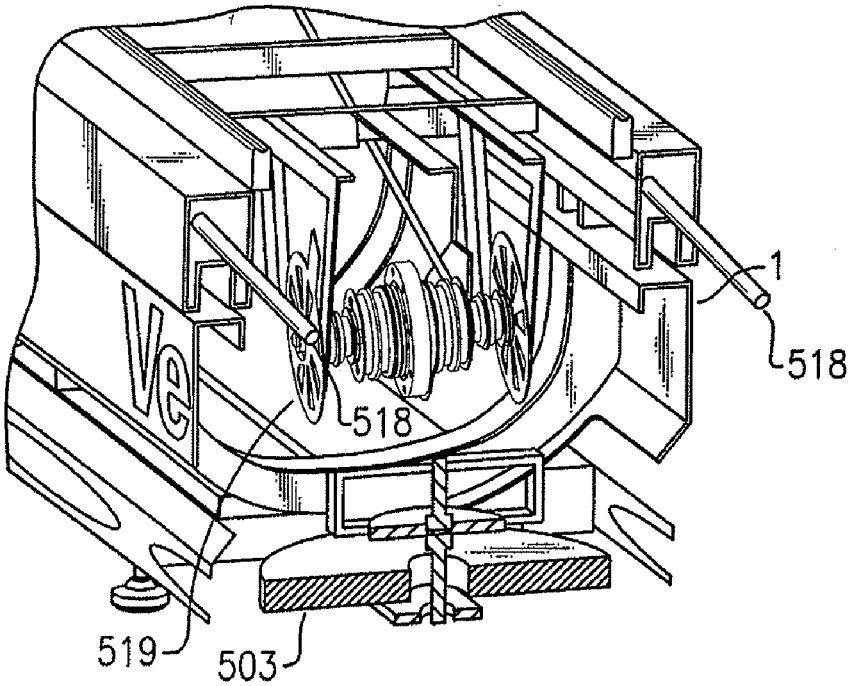
FIG. 14 is a rear perspective view that illustrates a cable or strap system, and a resistance mechanism assembly rotatably mounted to the structure of the shell, in accordance with an alternative embodiment of the present invention.
Figure 15:
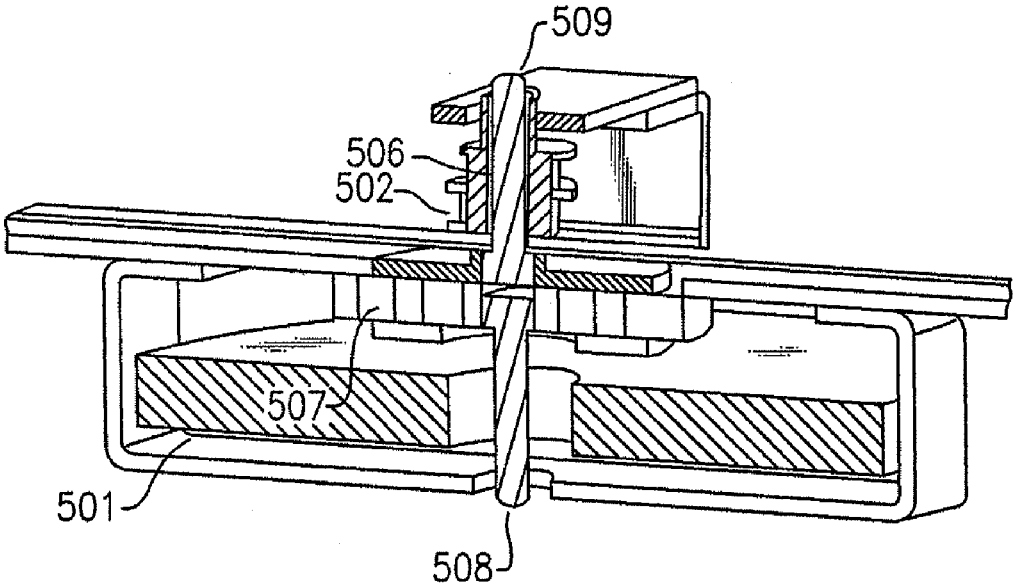
FIG. 15 is a close-up a sliced side view that illustrates a resistance mechanism assembly rotatably mounted to the structure of the shell, in accordance with an alternative embodiment of the present invention.
Figure 16:
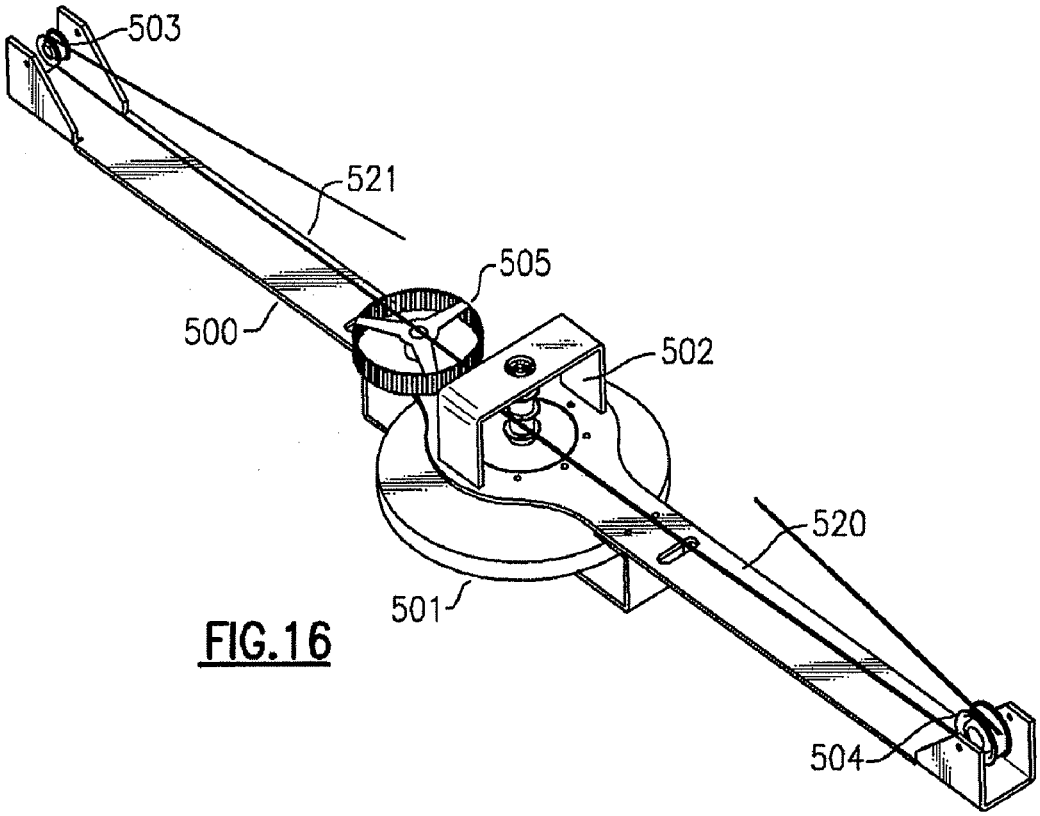
FIG. 16 is a top perspective view that illustrates a resistance mechanism assembly in accordance with an alternative embodiment of the present invention.
Figure 19:
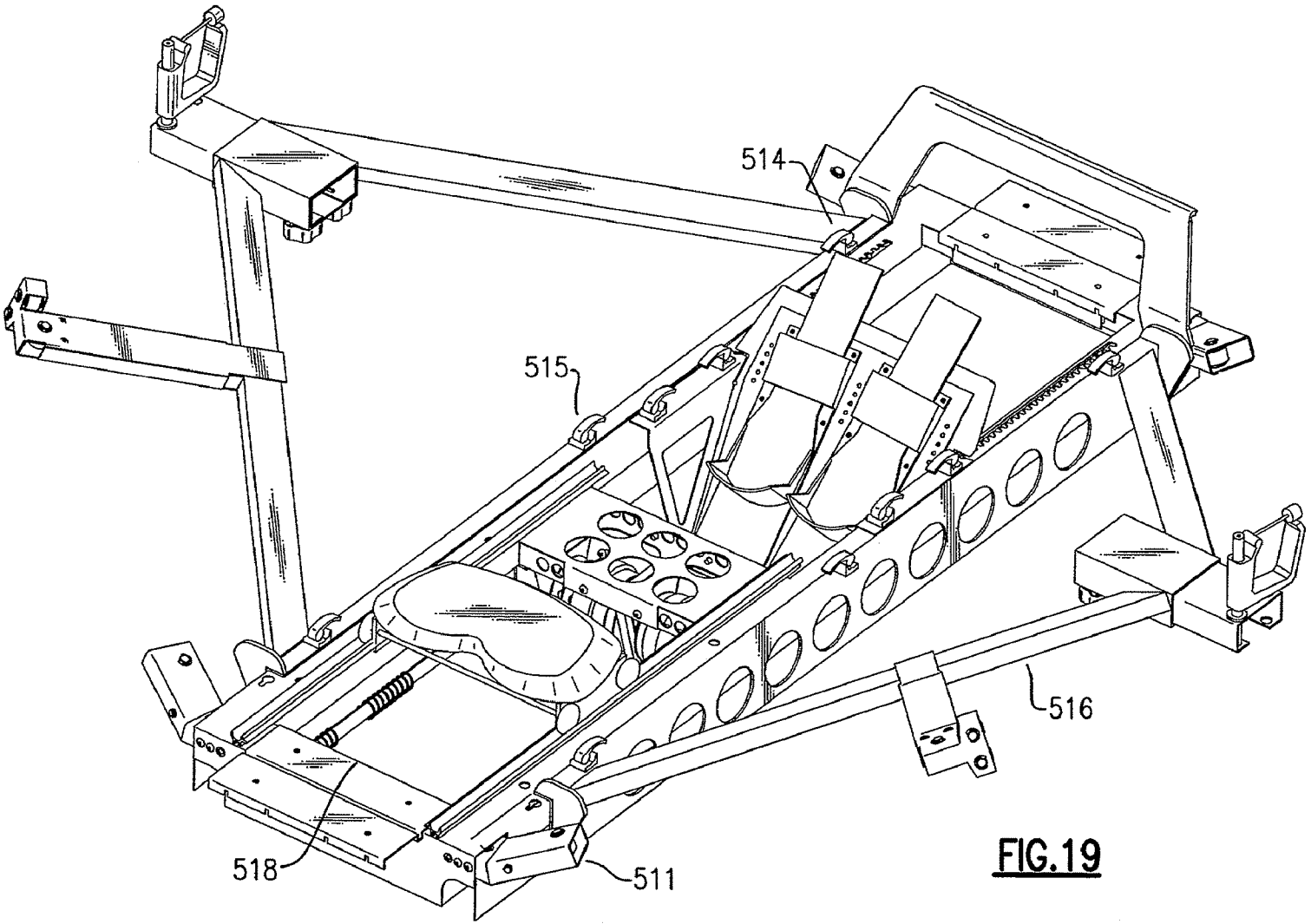
FIG. 19 is a top perspective view that illustrates a cable or strap system and rigger assembly, in accordance with an alternative embodiment of the present invention.

An alternative embodiment of the cable or strap system is shown in FIG. 14 and FIG. 19. This alternative embodiment of the cable or strap system includes a recovery cable or strap 518 traveling from the front 100 of the sled 1 down its length and turning back to the drive winch 40 (not shown) via the cable or strap guide system 517. This places the drive cable and strap (not shown) in parallel as they approach the drive winch 40.

An additional embodiment of the rigger assembly 516, as shown in FIG. 19, includes a more triangular shape that allows for both an adjustable and durable design. The thru-pin adjustment is made possible through quick release clamps 515, commonly used by those skilled in the art. The spread of the pins can be adjusted by sliding the pin mount in and out from the center of the machine. Other embodiments can include wing rigger designs and Euro rigger designs known to those skilled in the art.

Figure 20:
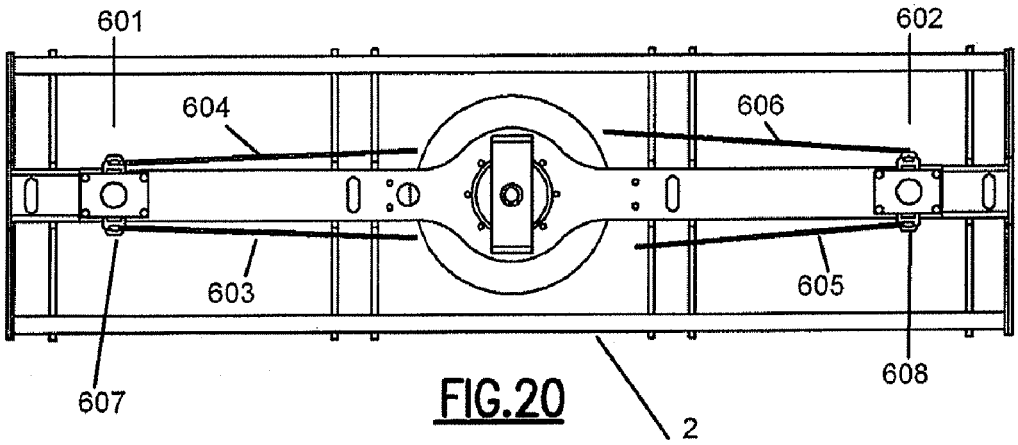
FIG. 20 is a top view that illustrates a resistance mechanism assembly comprising a clutch mechanism assembly comprising at least one toggle arm, according to an alternative embodiment of the present invention.

In accordance with an embodiment of the present invention, an alternative embodiment of the resistance mechanism assembly comprising a clutch mechanism assembly comprising at least one toggle arm is provided. As shown in FIG. 20, two toggle arms of a clutch mechanism rotatably mounted to a shell 2 are illustrated, one in the front of the machine 601, and one in the rear 602 (a similar embodiment of the resistance mechanism assembly rotatably mounted to the shell was shown and described supra with reference to FIGS. 13-18, but this embodiment could be applied to either the vertical or horizontal configuration of the resistance mechanism assembly). Both the front two drive cables 603, 604 and rear two drive cables 605, 606 are attached to the toggle arms 607, 608. These cables work as a feedback mechanism between the two clutches (not shown) as to allow the user to keep both clutches engaged. That is, as one clutch engages and takes in a drive cable it first works to pull on one side of a toggle arm and pulls it towards the resistance mechanism assembly. This action moves the other side of the of the toggle away from the resistance mechanism assembly causing the outside chamber of the un-driven clutch to rotate in the opposite direction and let out a drive cable. Once this clutch is also engaged through the movement of the oar, for example, the opposing forces from each side work to keep both clutches engaged. The sled moves once both sides are engaged or one side has exhausted its freedom to move.

In addition, this clutch mechanism assembly allows the user to qualitatively feel the resistance on one oar from the other. The two toggles exist 601, 602, one in the front of the machine and one in the rear as to allow for a fully closed loop.

When machines are coupled, for example, toggles between machines may be attached via a strap, cable or arm. This allows the same feedback mechanism to be employed across all coupled machines. In this way, when in a team formation and in a sweep or sculling configuration, every rower can feel the engagement and resistance from every other user's oar.

When one machine is used in a sweep configuration, this toggle mechanism can be locked in place as feedback between left and right clutches is no longer necessary. One clutch will engage and release while the unused clutch freely spins as the sled moves for and aft.

Figure 21:
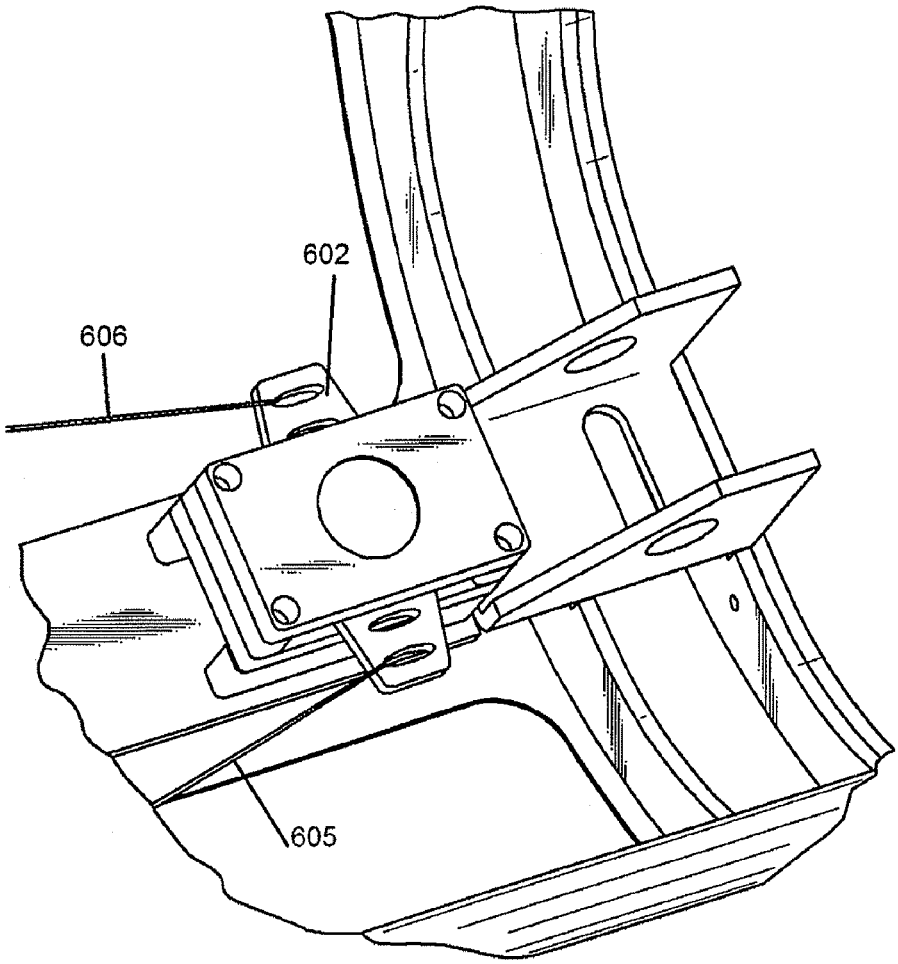
FIG. 21 is a top close-up view of a toggle arm as shown in FIG. 20, according to an alternative embodiment of the present invention.

FIG. 21 shows a close-up view of the toggle arm 602.

One alternative embodiment of the resistance mechanism assembly can include layered disks whereby one or a select few of the disks (e.g., the disk on the bottom of the "stack") is driven by the output shaft on the planetary gear system. The friction among flywheels creates the resistance, and momentum is conserved through the fractional amount of rotational momentum transferred to the other flywheels. Users are able to adjust the resistance on the machine by adding or removing layered disks from the "stack."

An additional alternative embodiment of the resistance mechanism assembly can include an electromagnetic brake that would work in the same manner as the blower wheel (as described supra) in that it would act as an external resistance on the flywheel that could be adjusted by the user. This could be applied to either the vertical or horizontal configuration of the flywheel.

An additional alternative embodiment of the resistance mechanism assembly can include a centripetal break whereby forces expand the pads of the break towards a cylinder wall in which the break is imbedded. The pads can create more resistance force as the angular speed of the break increases. This could be applied to either the vertical or horizontal configuration of the flywheel.

In accordance with an alternative embodiment of the present invention, an alternative embodiment of the clutch is provided. This embodiment of the clutch can include an electromagnetic clutch whereby the clutch is engaged by a switch. This switch can be tied to the motion of the oar(s) whereby the upward motion of the oar can activate the clutch via the switch.

While several embodiments of the invention have been discussed, it will be appreciated by those skilled in the art that various modifications and variations of the present invention are possible. Such modifications do not depart from the spirit and scope of the invention.

What is claimed is:

1. A rowing machine comprising:

a sled-rigger assembly comprising at least one extension member, a front end and a rear end defining a longitudinal axis there between, wherein said rear end comprises a first rear end connecting member guide;

a first oar assembly comprising a first oar member constrained to said sled-rigger assembly via at least one said extension member, so that said first oar member is at least free to rotate with respect to said sled-rigger assembly, wherein said first oar assembly has a first connection portion;

a first drive winch rotatably mounted to said sled-rigger assembly; and a first drive connecting member assembly comprising a first drive flexible connecting member having a first connection portion, said first connection portion of said first drive flexible connecting member of said first drive connecting member assembly being mechanically connected to the first connection portion of said first oar member, and wherein said first drive flexible connecting member of said first drive connecting member assembly is operatively engaged with said first rear end connecting member guide, wherein at least a portion of said first drive flexible connecting member is fully circumferentially connected to said first drive winch and is adapted to rotate said first drive winch in a first direction.

2. The rowing machine of claim 1, wherein said front end further comprises a first front end connecting member guide.

3. The rowing machine of claim 2, wherein said first oar member further comprises a second connection portion.

4. The rowing machine of claim 3, wherein said first drive connecting member assembly further comprises a first recovery flexible connecting member having a first connection portion, said first connection portion of said first recovery flexible connecting member of said first drive connecting member assembly being mechanically connected to the second connection portion of said first oar member, and wherein said first recovery flexible connecting member of said first drive connecting member assembly is operatively engaged with said first front end connecting member guide, is circumferentially connected to said first drive winch, and is adapted to rotate said first drive winch in a second direction.

5. The rowing machine of claim 4, wherein said first direction of rotation of said first drive winch is different from said second direction of rotation of said first drive winch.

6. The rowing machine of claim 5, further comprising a first clutch rotatably mounted to said sled-rigger assembly and operatively engaged with said first drive winch.

7. The rowing machine of claim 6, further comprising a first carrier winch rotatably mounted to said sled-rigger assembly, said first carrier winch being adapted to be operatively engaged and disengaged to said first drive winch via said first clutch.

8. The rowing machine of claim 7, wherein said first drive winch is adapted to drive said first carrier winch in said first direction via said first clutch when said first drive winch is operatively engaged with said carrier winch via said first clutch.

9. The rowing machine of claim 8, wherein said first clutch is a unidirectional clutch.

10. The rowing machine of claim 8, wherein said first clutch is a bidirectional overrunning clutch.

11. The rowing machine of claim 10, wherein said first carrier winch is adapted to overrun in said first direction and in said second direction.

12. The rowing machine of claim 8, further comprising a first resistance assembly rotatably mounted to said sled-rigger assembly, said first resistance assembly is operatively engaged to said first carrier winch.

13. The rowing machine of claim 12, wherein said first carrier winch is adapted to drive said first resistance assembly in said first direction.

14. The rowing machine of claim 13, wherein said first resistance assembly further comprises a first weight component and a first dampening component.

15. The rowing machine of claim 13, wherein said first resistance assembly comprises a first flywheel.

16. The rowing machine of claim 8, further comprising a shell-base assembly comprising a front end and a rear end, upon which said sled-rigger assembly is constrained so that it can move with respect to said shell-base assembly along said longitudinal axis.

17. The rowing machine of claim 16, wherein said front end of said shell-base assembly further comprises a first front connecting member mount.

18. The rowing machine of claim 17, further comprising a first sled-drive connecting member assembly comprising a first sled-drive flexible connecting member having a first connection portion, said first connection portion of said first sled-drive flexible connecting member of said first sled-drive connecting member assembly being mechanically connected to the first front connecting member mount, and wherein said first sled-drive flexible connecting member of said first sled-drive connecting member assembly is operably connected to said first carrier winch, and is adapted to move said sled-rigger assembly in a first direction along said longitudinal axis.

19. The rowing machine of claim 18, wherein said rear end of shell-base assembly further comprises a first rear connecting member mount.

20. The rowing machine of claim 19, wherein said first sled-drive connecting member assembly further comprises a first sled-recovery flexible connecting member having a first connection portion, said first connection portion of said first sled-recovery flexible connecting member of said first sled-drive connecting member assembly being mechanically connected to the first rear connecting member mount, and wherein said first sled-recovery flexible connecting member of said first sled-drive connecting member assembly is operably connected to said first carrier winch.

21. The rowing machine of claim 20, further comprising a recoil mechanism adapted to move said sled-rigger assembly in a second direction along said longitudinal axis.

22. The rowing machine of claim 4, wherein said rear end comprises a second rear end connecting member guide.

23. The rowing machine of claim 22, further comprising a second oar member, having a first connection portion, constrained to said sled-rigger assembly so that said second oar member is at least free to rotate with respect to said sled-rigger assembly.

24. The rowing machine of claim 23, further comprising a second drive winch rotatably mounted to said sled-rigger assembly.

25. The rowing machine of claim 24, further comprising a second drive connecting member assembly comprising a first drive flexible connecting member having a first connection portion, said first connection portion of said first drive flexible connecting member of said second drive connecting member assembly being mechanically connected to the first connection portion of said second oar member, and wherein said first drive flexible connecting member of said second drive connecting member assembly is operatively engaged with said second rear end connecting member guide, is circumferentially connected to said second drive winch, and is adapted to rotate said second drive winch in a first direction.

26. The rowing machine of claim 25, wherein said front end further comprises a second front end connecting member guide.

27. The rowing machine of claim 26, wherein said second oar member further comprises a second connection portion.

28. The rowing machine of claim 27, wherein said second drive connecting member assembly further comprises a first recovery flexible connecting member having a first connection portion, said first connection portion of said first recovery flexible connecting member of said second drive connecting member assembly being mechanically connected to the second connection portion of said second oar member, and wherein said first recovery flexible connecting member is operatively engaged with said second front end connecting member guide, is circumferentially connected to said second drive winch, and is adapted to rotate said second drive winch in a second direction.

29. A rowing machine comprising:

an elongated shell;

a base member adapted to, in operation of said rowing machine, rest on and remain at least substantially fixed with respect to the ground, wherein said elongated shell and base member comprise a shell-base assembly;

a sled member comprising a front end and a rear end defining a longitudinal axis there between being constrained to said shell-base assembly so that said sled member, in operation of said rowing machine, can move with respect to said shell-base assembly along said longitudinal axis; and a seat connected to said sled member, wherein said seat is adapted to, in operation of said rowing machine, move along said longitudinal axis with respect to said sled member when said sled member is moving.

30. The rowing machine of claim 29, further comprising:

a resistance mechanism assembly mechanically connected to said shell-base assembly comprising:

a frame;

a winch rotatably mounted to said frame.

31. A rowing machine comprising:

a base member adapted to, in operation of the machine, rest on and remain at least substantially fixed with respect to the ground;

a first rotational member constrained to the base member;

an elongated shell member comprising an elongated first surface defining a first longitudinal direction, with said elongated shell member being located at least substantially on top of said base member so that said first surface can rotate with respect to said first rotational member along the first longitudinal direction, and with said elongated shell member being constrained so that can move with respect to said base member only along the first longitudinal direction;

a sled member comprising a front end and a rear end defining a longitudinal axis there between constrained with respect to the elongated shell member so that it can move with respect to said elongated shell member only in a second longitudinal direction; and a seat connected to said sled member.

32. The rowing machine of claim 31, wherein the first rotational member comprises a first roller member constrained to the base so that it can rotate with respect to the base in a first angular direction.

33. The rowing machine of claim 32, wherein the first surface has at least a substantially arcuate shape.

34. The rowing machine of claim 33, wherein the second longitudinal direction is at least substantially linear.

35. The rowing machine of claim 34, wherein the second longitudinal direction is at least substantially perpendicular to the first longitudinal direction.

36. The rowing machine of claim 35, further comprising a user platform shaped to accommodate a user, with said user platform being constrained to said sled member so that said user platform can move with respect to said sled member along a third longitudinal direction.

37. The rowing machine of claim 36, wherein the third longitudinal direction is at least substantially linear.

38. The rowing machine of claim 37, wherein the third longitudinal direction is at least substantially identical to the second longitudinal direction.

39. The rowing machine of claim 38, wherein the user platform is shaped as a seat suitable for accommodating a user in the sitting position.

40. The rowing machine of claim 39, further comprising a first oar member mechanically connected to the sled.

41. The rowing machine of claim 40, wherein said elongated shell member further comprises a first retaining slot.

42. The rowing machine of claim 41, wherein said base member further comprises a first wheel-shell captivator and dampener mechanically connected to said first retaining slot.

43. The rowing machine of claim 31, wherein the length of said elongated shell member extends from the front end of the sled member to the rear of the sled member.

44. The rowing machine of claim 1, wherein said first drive flexible connecting member is selected from the group consisting of a chain and any one of a cable, a rope, a belt, a strap, a cord, and a wire.

* * * * *